US009056692B2

(12) United States Patent
Yuyama et al.

(10) Patent No.: US 9,056,692 B2
(45) Date of Patent: Jun. 16, 2015

(54) MEDICINE PACKAGING APPARATUS

(75) Inventors: Shoji Yuyama, Toyonaka (JP); Nakaji Takeda, Toyonaka (JP)

(73) Assignee: YUYAMA MFG. CO., LTD., Osaka (JP)

( * ) Notice: Subject to any disclaimer, the term of this patent is extended or adjusted under 35 U.S.C. 154(b) by 1049 days.

(21) Appl. No.: 13/121,856

(22) PCT Filed: Sep. 18, 2009

(86) PCT No.: PCT/JP2009/004719
§ 371 (c)(1),
(2), (4) Date: Mar. 30, 2011

(87) PCT Pub. No.: WO2010/038377
PCT Pub. Date: Apr. 8, 2010

(65) Prior Publication Data

US 2011/0197547 A1 Aug. 18, 2011

(30) Foreign Application Priority Data

Oct. 2, 2008 (JP) ..... 2008-257585

(51) Int. Cl.
*B65B 9/06* (2012.01)
*B65B 5/10* (2006.01)
(Continued)

(52) U.S. Cl.
CPC . *B65B 51/28* (2013.01); *B65B 1/22* (2013.01); *B65B 1/30* (2013.01); *B65B 5/103* (2013.01); *B65B 9/067* (2013.01); *B65B 43/04* (2013.01); *B65B 61/025* (2013.01)

(58) Field of Classification Search
CPC ..... A61J 7/0084; B65B 61/025; B65B 9/073; B65B 9/067; B65B 9/06; B65B 51/28; B65B 5/103; B65B 9/093; B65B 9/087; B65B 9/08; B65B 2009/063
USPC ..... 53/131.5, 568, 459
See application file for complete search history.

(56) References Cited

U.S. PATENT DOCUMENTS 2,885,848 A * 5/1959 Brien et al. ..... 53/550
3,359,703 A 12/1967 Quaadgras
(Continued)

FOREIGN PATENT DOCUMENTS

CN 1496924 5/2004
CN 1532117 9/2004
(Continued)

OTHER PUBLICATIONS

International Search Report issued Dec. 28, 2009 in International (PCT) Application No. PCT/JP2009/004719, 1 page.
(Continued)

*Primary Examiner* — Stephen F Gerrity
(74) *Attorney, Agent, or Firm* — Wenderoth, Lind & Ponack, L.L.P.

(57) ABSTRACT

In a medicine packaging apparatus, a distance from a printing section to a heat sealing section is reduced without generating wrinkles on a package sheet. An unfolding guide 65 for unfolding and opening a package sheet 61 provided in a packaging unit 4 includes a main ridge 94 extending along with a crease of the package sheet 61 and a pair of unfolding guide surfaces 95*a*, 95*b* which are convex curved surfaces stretching from the main ridge 94. A contact start position 100*a* with the package sheet 61 of the unfolding guide surface 95*a* on the outer side of a curve in the conveying direction A relative to the main ridge 94 is located on an upstream side in the conveying direction A of the package sheet 61 of a contact start position 100*b* with the package sheet 61 of the unfolding guide surface 95*b* located on the inner side of the curve relative to the main ridge 94.

14 Claims, 37 Drawing Sheets

(51) Int. Cl.

| | |
|---|---|
| ***B65B 61/00*** | (2006.01) |
| ***B65B 51/28*** | (2006.01) |
| ***B65B 1/30*** | (2006.01) |
| ***B65B 9/067*** | (2012.01) |
| ***B65B 61/02*** | (2006.01) |
| *B65B 1/22* | (2006.01) |
| *B65B 43/04* | (2006.01) |

(56) References Cited

U.S. PATENT DOCUMENTS

| | | | | |
|---|---|---|---|---|
| 3,748,822 | A * | 7/1973 | Borgardt | 53/550 |
| 4,411,123 | A * | 10/1983 | Gautier | 53/550 |
| 5,287,681 | A * | 2/1994 | Vernon et al. | 53/550 |
| 5,845,463 | A | 12/1998 | Henaux | |
| D605,210 | S * | 12/2009 | Yuyama et al. | D15/145 |
| 7,886,508 | B2 * | 2/2011 | Yuyama et al. | 53/568 |
| 8,584,434 | B2 * | 11/2013 | Kodama et al. | 53/246 |
| 2010/0018986 | A1 * | 1/2010 | Kodama et al. | 221/8 |
| 2010/0107555 | A1 | 5/2010 | Yuyama et al. | |

FOREIGN PATENT DOCUMENTS

| | | | | |
|---|---|---|---|---|
| DE | 1024868 | B * | 2/1958 | B65B 9/06 |
| EP | 2 130 770 | | 12/2009 | |
| JP | 2002-19737 | | 1/2002 | |
| JP | 2004-189336 | | 7/2004 | |
| JP | 2004-238026 | | 8/2004 | |
| JP | 2004-284663 | | 10/2004 | |
| JP | 2004-291976 | | 10/2004 | |
| JP | 2008-273624 | | 11/2008 | |
| KR | 10-2004-0034409 | | 4/2004 | |
| KR | 10-2004-0084703 | | 10/2004 | |
| WO | WO 2008035701 | A1 * | 3/2008 | B65B 5/103 |
| WO | 2008/120657 | | 10/2008 | |

OTHER PUBLICATIONS

Patent Cooperation Treaty (PCT) International Preliminary Report on Patentability issued May 19, 2011 in corresponding International Application No. PCT/JP2009/004719, 6 pages.

Extended European Search Report (in English language) issued Mar. 22, 2012 in corresponding European Patent Application No. 09 81 7420, 6 pages.

* cited by examiner

MEDICINE PACKAGING APPARATUS

TECHNICAL FIELD

The present invention relates to a medicine packaging apparatus for packaging medicine such as a tablet including a capsule tablet and powdered medicine.

BACKGROUND ART

Various medicine packaging apparatuses have been provided which prepare continuous medicine bags or dose packages by packaging medicine such as a tablet and powdered medicine per dose (as one medicine bags) based on prescriptions. Some of these devices use package sheet rolls on which a long and narrow package sheet previously folded into two in the longitudinal direction is wound. Generally, in a packaging section of this kind of medicine packaging apparatus, a package sheet is fed from the roll, and required information is printed thereon by a printing section. The package sheet is then unfolded from the folded state to be opened, and a nozzle section of a hopper is inserted into the opening to introduce one dose of the medicine. Next, the package sheet is sealed (heat-sealed) in a heat sealing section so that the medicine is enclosed (see, e.g., JP 2004-189336 A, JP 2004-284663 A, JP 2004-238026 A, and JP 2002-19737 A)

Upon first startup of the medicine packaging apparatus or at the time of roll replacement, it is necessary to routing a package sheet unrolled from the roll to the heat sealing section through the nozzle section of the hopper and the printing section before starting medicine packaging operation. In other words, in the roll replacement and the like, a length of the package sheet from the printing section to the heat sealing section (length generally equivalent to 5 to 6 packages) functions only for the routing, i.e., the length is not used for medicine packaging and therefore should be discarded, which is not desirable in view of cost. Moreover, the long path of the package sheet from the printing section to the heat sealing section hinders downsizing of the medicine packaging apparatus. Accordingly, reduction in path length from the printing section to the heat sealing section can eliminate a waste of the package sheet caused by the roll replacement and the like and achieve the downsizing of the device. However, merely shortening the path cannot prevent generation of wrinkles on the package sheet in a portion of the heat sealing section. Generation of the wrinkles is particularly notable when the heat sealing section employs a method of heat-sealing the package sheet by passing the package sheet between a pair of heater rollers.

With reference to FIGS. 46 and 47, a two-folded package sheet 1100 is expanded into V shape by an unfolding guide 1106, and reaches a heating roller 102 of a heat sealing section via a nozzle section 1101 of a hopper. The heater roller 102 has a horizontal seal 1103 which seals an opening edge of the package sheet 1100 in the longitudinal direction, and a vertical seal 1104 which seals the package sheet 1100 crosswise from the opening edge to a crease of the package sheet 1100. If the tension applied to the two portions of the two-folded sheet 1100 is unbalanced during application of the vertical seal 1104, one of the portions of the two-folded sheet 1100 sags against the other portion, which tends to generate wrinkles 1105 extending in the longitudinal direction near the horizontal seal 1103. The wrinkles 1105 are assumed to be attributed to such causes as a bulge of the package sheet 1100 generated in putting medicine therein and a difference of tension between the portions of the package sheet 1100 where the horizontal seal 1103 is formed and where the vertical seal 1104 is formed. Such wrinkles 1105 result in poor airtightness due to sealing failure and thereby cause mixture (contamination) of the medicine between adjacent prescriptions.

Patent Documents 1, 2 disclose an unfolding guide 1106 in the shape of a triangular plate with a constant thickness and an unfolding guide 1106 constituted of a plurality of flat planes and having an outline of a generally triangular pyramid shape. However, if the unfolding guides 1106 in such shapes are employed and placed in the vicinity of the printing section to shorten the path length from the printing section to the heat sealing section, the above-mentioned wrinkles 1105 are unavoidably generated on the package sheet 1100.

DISCLOSURE OF THE INVENTION

Problems to be Solved by the Invention

An object of the present invention is provide a medicine packaging device having a shortened distance from a printing section to a heat sealing section without generating wrinkles on package sheets.

Means for Solving the Problems

The present invention provides a medicine packaging apparatus, comprising: a sheet supply section for unrolling and feeding an elongated package sheet from a roll on which the package sheet is wound, the package sheet previously being folded along its longitudinal direction into two portions; a printing section for making a print on the package sheet fed from the sheet supply section; a curvature guide for curving a conveying direction of the package sheet having passed the printing section; an unfolding guide arranged on a downstream side of the curvature guide in the conveying direction of the package sheet, the unfolding guide being for unfolding and opening the two-folded package sheet; a medicine introducing section arranged on the downstream side of the unfolding guide in the conveying direction of the package sheet, the medicine introducing section being for introducing a medicine into an opening of the package sheet; and a heat sealing section arranged on the downstream side of the medicine introducing section in the conveying direction of the package sheet, the heat sealing section being for sealing the package sheet so as to enclose the introduced medicine, wherein the unfolding guide comprises: a main ridge extending along with a crease of the package sheet; and a pair of unfolding guide surfaces which are convex curved surfaces stretching from the main ridge and which respectively come into contact with the two portions of the folded package sheet, and wherein, seen from the direction facing the main ridge, a contact start position of one of the unfolding guide surfaces on an outer side of a curve of the conveying direction by the curvature guide relative to the main ridge is located on an upstream side in the conveying direction of the package sheet with respect to the other contact start position of the other of the unfolding guide surfaces on an inner side of the curve of the conveying direction by the curvature guide relative to the main ridge.

The unfolding guide is provided with the pair of unfolding guide surfaces which are convex curved surfaces stretching from the main ridge. Since the two-folded package sheet is guided with the pair of unfolding guide surfaces and thereby gently deformed or unfolded while being smoothly fed to the heat sealing section so that an opening can be formed. Therefore, even if the printing section, the unfolding guide, and the heat sealing section are placed in the vicinity of each other, it becomes possible to prevent wrinkles from being generated on the package sheet in the heat sealing section. In other words, the shape of the unfolding guide enables the printing section, the curvature guide, the unfolding guide, the medicine introducing section, and the printing section to be placed in the vicinity of each other so as to reduce a distance from the printing section to the heat sealing section without generating the wrinkles on the package sheet. As a result, the length of the useless package sheet used only for routing upon the initial startup of the medicine packaging apparatus or at the time of roll replacement and not for packaging of the medicine (package sheet from the printing section to the heat sealing section) can be reduced to the minimum, and thereby running cost reduction can be achieved. Moreover, downsizing of the device can be attained by reducing the distance from the printing section to the heat sealing section.

The contact start position with the package sheet of the unfolding guide surface on the outer side of the curve in the conveying direction is located on the upstream side in the conveying direction of the contact start position with the package sheet of the unfolding guide surface on the inner side of the curve. By this setting of the contact start positions, the portion of the two-folded package sheet on the outer side of the curve and the portion on the inner side of the curve start to come into contact with the unfolding guide surfaces at the same time. As a result, the two-folded package sheet can be more smoothly unfolded so that the opening can be formed, and it becomes possible to more reliably prevent the wrinkles from being generated on the package sheet in the heat sealing section.

More specifically, seen from the conveying direction of the package sheet, a distance between the pair of unfolding guide surfaces increases as the unfolding guide surfaces are farther away from the main ridge, and wherein, seen from the direction facing the main ridge, the distance between the unfolding guide surfaces becomes narrower from the upstream side to the downstream side in the conveying direction.

Preferably, each of the unfolding guide surfaces includes: a rear end edge gradually coming close to the main ridge from the upstream side to the downstream side in the conveying direction of the package sheet, the rear end edge being jointed to an end section of the main ridge on the downstream side in the conveying direction of the package sheet; and a first concave section formed in a portion ranging from a position spaced from the main ridge to the rear end edge in a region between a position spaced from the contact start positions on the downstream side in the conveying direction of the package sheet and the end section on the downstream side.

When the medicine is introduced into the opening of the two-folded package sheet from the medicine introducing section on the downstream side of the unfolding guide, the two-folded package sheet is bulged in accordance with the volume of the medicine (a distance between the two portions of the two-folded package sheet is stretched). Particularly when the volume of the medicine to be introduced is large, the bulge of this package sheet is notable. With the first concave section provided in the unfolding guide surface, when the package sheet is bulged in accordance with the introduction of the medicine, the package sheet comes into close contact with the first concave section of the unfolding guide surface, and an amount of the package sheet corresponding to this close contact is fed to a portion on the downstream side of the unfolding guide into which the medicine is introduced. Accordingly, by providing the first concave section in the unfolding guide surface, even when the bulge is generated in accordance with the introduction of the medicine, it becomes possible to prevent excessive tension applied to the package sheet. As a result, it becomes possible to more reliably prevent wrinkles from being generated on the package sheet in the heat sealing section. In other words, with the first concave section provided in the unfolding guide surface, the package sheet can be unfolded in a state that some margins are left for the bulge of the package sheet in accordance with the introduction of the medicine (a state that the bulge can be "absorbed"), so that the opening can be formed. Thereby, it becomes possible to more reliably prevent the wrinkles from being generated in the heat sealing section. Since the package sheet has the margins for the bulge due to the first concave section, the package sheet can ease a shock received from the medicine introduced from the medicine introducing section. By this shock easing, it becomes possible to prevent the medicine (powdered medicine in particular) from being blown up in the two-folded package sheet.

Preferably, each of the unfolding guide surfaces includes a second concave section formed on the downstream side of the first concave section in the conveying direction of the package sheet in a region including the end section of the main ridge on the downstream side.

With the second concave section provided in the unfolding guide surface in the portion including the end section of the main ridge on the downstream side, when the package sheet is bulged in accordance with the introduction of the medicine, the package sheet comes into close contact with the second concave section, and an amount of the package sheet corresponding to this close contact is fed to the portion on the downstream side of the unfolding guide into which the medicine is introduced. That is, by providing the second concave section in addition to the first concave section, a margin amount for the bulge of the package sheet in accordance with the introduction of the medicine is increased. Thus, even when the volume of the medicine to be introduced is large, it becomes possible to more reliably prevent excessive tension applied to the package sheet, and hence it becomes possible to more reliably prevent the wrinkles from being generated in the heat sealing section. By the increase in the margin amount, the shock received from the medicine introduced from the medicine introducing section can be more effectively eased. Thus, it becomes possible to more reliably prevent the medicine from being blown up in the two-folded package sheet.

Preferably, an area of the second concave section of the unfolding guide surface located on the outer side of the curve in the conveying direction made by the curvature guide relative to the main ridge is larger than an area of the second concave section of the unfolding guide surface located on the inner side of the curve in the conveying direction made by the curvature guide relative to the main ridge.

Larger tension tends to be applied to the portion of the two-folded package sheet on the outer side of the curve than the portion on the inner side. When the area of the second concave section of the unfolding guide surface located on the outer side of the curve in the conveying direction made by the curvature guide relative to the main ridge is set to be larger than the area of the second concave section of the unfolding guide surface located on the inner side of the curve in the conveying direction made by the curvature guide relative to the main ridge, the margin amount for the bulge of the package sheet in accordance with the introduction of the medicine on the outer side of the curve becomes larger than the margin amount on the inner side of the curve. Thus, it becomes possible to more effectively prevent excessive tension applied to the portion of the two-folded package sheet on the outer side of the curve due to the bulge of the package sheet by the introduction of the medicine.

A linear projection extending in the direction crossing the main ridge may be provided at a position adjacent to the contact start position of the unfolding guide surface located on the outer side of the curve in the conveying direction by the curvature guide relative to the main ridge.

Since larger tension tends to be applied to the portion of the two-folded package sheet on the outer side of the curve than the portion on the inner side, frictional resistance between the package sheet and the unfolding guide surface tends to be larger on the outer side of the curve than on the inner side of the curve. By providing the linear projection, a contact area between the portion of the two-folded package sheet on the outer side of the curve and the unfolding guide surface can be reduced. Since the frictional resistance between the package sheet and the unfolding guide surface is reduced by this reduction of the contact area, the package sheet can be unfolded while being more smoothly fed to the heat sealing section. Thereby, it becomes possible to more reliably prevent the wrinkles from being generated in the heat sealing section.

Preferably, a bulge amount of the unfolding guide surface located on the inner side of the curve in the conveying direction by the curvature guide relative to the main ridge is larger than a bulge amount at the contact start position of the unfolding guide surface located on the outer side of the curve in the conveying direction by the curvature guide relative to the main ridge.

The tension applied to the portion of the two-folded package sheet on the inner side of the curve tends to be smaller than the tension applied to the portion on the outer side of the curve. By setting the bulge amount of the unfolding guide surface at the contact start position to be larger on the inner side of the curve than on the outer side of the curve, uniform tension is applied to the package sheet, and it becomes possible to more reliably unfold the two-folded package sheet in a non-wrinkle state.

The unfolding guide further comprises: a sub ridge extending from an end section of the main ridge on the upstream side in the conveying direction of the package sheet to the upstream side in the conveying direction of the package sheet; and a pair of top surfaces which are convex curved surfaces stretching from the sub ridge and which are joined to the unfolding guide surfaces.

Even when the medicine (powdered medicine in particular) introduced from the medicine introducing section descends to the top surface of the unfolding guide due to blowing-up and the like, the medicine falls to the package sheet without remaining on the top surface since the top surface is a curved surface.

The heat sealing section is of a roller type which seals the package sheet by passing the package sheet between a pair of rotatable heater rollers. Alternatively, the heat sealing section may be of a pack type which has a pair of heating plates intermittently moving between a position where the package sheet is held to be sealed and other position where the plates are detached from the package sheet.

Preferably, the medicine packaging apparatus further includes a first vibration applying mechanism for applying vibration to the unfolding guide. More specifically, the first vibration applying mechanism includes a first vibration source fixed within the unfolding guide.

Since applying the vibration to the unfolding guide by the first vibration applying mechanism smoothes movement or flow of the medicine (powdered medicine in particular) within the two-folded package sheet, it becomes possible to reliably prevent the medicine from adhering to and remaining on the medicine introducing section (a hopper).

Preferably, the medicine introducing section is provided with a hopper having an inlet opening into which the medicine is fed on the upper side and a nozzle section inserted into the opening of the two-folded package sheet for introducing the medicine into the package sheet on the lower, and the medicine packaging apparatus further includes a second vibration applying mechanism for applying vibration to the hopper. More specifically, the second vibration applying mechanism is provided with a second vibration source and a holding structure for holding the second vibration source and the hopper.

The second vibration applying mechanism applies the vibration to the hopper, so that it becomes possible to effectively prevent the medicine (powdered medicine in particular) from adhering to and remaining on the hopper, and to eliminate contamination in the hopper. As compared with a sound generated upon striking of the hopper, a sound caused by applying the vibration is small in volume and causes neither displeasure of an operator nor false detection of failure by the operator.

Effect of the Invention

In the medicine packaging apparatus of the present invention, the unfolding guide is provided with the pair of unfolding guide surfaces which are convex curved surfaces, and the contact start position with the package sheet of the unfolding guide surface located on the outer side of the curve in the conveying direction of the package sheet is set on the upstream side in the conveying direction of the package sheet of the contact start position with the package sheet of the unfolding guide surface located on the inner side of the curve. Thus, the printing section, the curvature guide, the unfolding guide, the medicine introducing section, and the printing section are placed in the vicinity of each other, and the distance from the printing section to the heat sealing section can be reduced without generating the wrinkles on the package sheet. The reduced distance from the printing section to the heat sealing section makes it possible to eliminate a waste of the package sheet due to the roll replacement and the like so as to achieve the running cost reduction while achieving the downsizing of the device. Moreover, the vibration applying mechanism for applying the vibration to the unfolding guide and the hopper is provided, so that the residual medicine in the hopper can be prevented without causing the displeasure and the false detection of the failure.

BEST MODES FOR CARRYING OUT THE INVENTION (First Embodiment)

FIG. 1 shows a medicine packaging apparatus 1 according to an embodiment of the present invention.

(Entire Configuration)

The medicine packaging apparatus 1 includes a tablet supply unit 2, a powdered medicine supply unit 3, a packaging unit 4, and a medicine discharge section 5 from which packaged medicine is discharged. The tablet supply unit 2 and the powdered medicine supply unit 3 are provided on the upper surface side of a housing 6. Meanwhile, the packaging unit 4 is arranged in housing space 7 inside the housing 6. An opening on the front surface of the housing 6 is openably covered by an openable and closable cover 8 in the shape of a single swinging door except for the medicine discharge section 5. When opening this cover 8, an operator can access the packaging unit 4 inside the housing space 7. The form of the cover 8 is not particularly limited, and another form such as a double leaf form may be employed. A control panel 9 is provided on the upper surface of the housing 6. Also with reference to FIG. 2, the operation of the tablet supply unit 2, the powdered medicine supply unit 3 and the packaging unit 4 are controlled by controllers 11, 12, 13 based on the inputs from the control panel 9, the inputs from various sensors 10A to 10D, and the prescription information inputted from the outside. In the present embodiment, the tablet supply unit 2 is controlled by the controller 11, the powdered medicine supply unit 3 is controlled by the controller 12, and the packaging unit 4 is controlled by the controller 13. However, two or more units among the tablet supply unit 2, the powdered medicine supply unit 3, and the packaging unit 4 may be controlled by a common controller.

(Tablet Supply Unit)

In the following, the tablet supply unit 2 is described with reference to FIGS. 3A to 5. First, with reference to FIGS. 3A, 3B, and 5, the tablet supply unit 2 includes a fixed tablet housing section 22 in which a plurality of tablet housing chambers 21 is provided in matrix form (and which constitutes part of the upper surface side of the housing 6 in the present embodiment) and a tablet discharging section 23 that automatically and sequentially takes out tablets for each dose supplied by manual distribution into the respective tablet housing chamber 21, and supplies the tablets to the packaging unit 4.

With reference to FIGS. 3A, 3B, and 4, the tablet housing section 22 in the present embodiment is provided with a total of 28 tablet housing chambers 21 in identical shape in four rows in the anteroposterior direction (row direction) and seven columns in the lateral direction (column direction). Both the upper and lower ends of the respective tablet housing chambers 21 are open. An upper end opening 21*a* functions as an opening for the operator to manually feed the tablets into the tablet housing chambers 21. A lower end opening 21*b* functions as an opening through which the tablets housed inside the tablet housing chambers 21 pass to the tablet discharging section 23.

With reference to FIG. 4, the tablet housing section 22 includes a closing cover 25 generally in sheet shape or plate shape and a protection cover 26 also having generally sheet shape or plate shape. The closing cover 25 and the protection cover 26 are rotatably fixed to the upper surface of the tablet housing section 22. When the protection cover 26 is at an open position, the closing cover 25 can be set to either an open position where the closing cover is receded from the tablet housing section 22 or to a closed position where the closing cover is placed on the tablet housing section 22 to close the upper end openings 21*a* of the seven tablet housing chambers 21 constituting the rearmost-side one row.

With reference to FIGS. 3A, 3B, and 5, the tablet discharging section 23 of the tablet supply unit 2 includes an upper shutter plate 34 arranged under the tablet housing section 22, a lower shutter plate 35 arranged in a state of being mutually superimposed under the upper shutter plate 34, a movable discharging member 36 arranged under the lower shutter plate 35, and a fixing plate 37 arranged under the discharging member 36.

The upper and lower shutter plates 34, 35 are movable in the column direction of the arrangement of the tablet housing chambers 21, while holding the mutually superimposed state. In each of the upper and lower shutter plates 34, 35, a total of 28 tablet passage holes 41 respectively corresponding to the tablet housing chambers 21 are formed in four rows and seven columns. Further, the left-side ends of the upper and lower shutter plates 34, 35 in FIGS. 3A and 3B are provided with downwardly folded engaging sections 34*a*, 35*a*. Moreover, the upper shutter plate 34 is connected to the tablet housing section 22 by a spring (not shown) so as to be elastically biased rightward in FIGS. 3A and 3B. Furthermore, the lower shutter plate 35 is connected to the upper shutter plate 34 by a spring (not shown) so as to be elastically biased rightward in FIGS. 3A and 3B. In an initial state where external force does not act upon the upper and lower shutter plates 34, 35, the upper and lower shutter plates 34, 35 are at positions shown in FIG. 3B.

The discharging member 36 is reciprocatingly movable in the column direction of the arrangement of the tablet housing chambers 21 by a driving device including a pinion-rack mechanism and a motor. The discharging member 36 is provided with a total of 28 tablet discharging chambers 42 having the open upper and lower ends in four rows and seven columns corresponding to the tablet housing chambers 21 of the tablet housing section 22. Openable and closable bottom plates 43 having rotatable one ends by pins 44 and embedded weights 45 for opening are arranged at the openings on the lower end side of the respective tablet discharging chambers 42.

The bottom plates 43 of the tablet discharging chambers 42 are placed on the upper surface of the fixing plate 37 and thereby the bottom plates 43 are held at a closed position. Further, the right-side end of the fixing plate 37 in FIGS. 3A, 3B, and 5 is provided with stages 37*a* to 37*d* in identical number to the number of rows of the tablet housing chambers 21 and the tablet discharging chambers 42 (four rows in the present embodiment).

In the following, the operation of the tablet supply unit 2 is described. First, the tablets are fed from the upper end openings 21*a* by the manual distribution operation and the tablets are housed in the respective tablet housing chambers 21. After that, when a start button of the control panel 9 is selected, the tablet discharging section 23 is operated to send the tablets supplied from the tablet housing section 22 to a hopper 67 of the packaging unit 4 through a carrier channel (not shown) one-by-one dose and packing processing is executed in the packaging unit 4. More specifically, before selection of the start button (during non-activation), the tablet discharging section 23 is in a state shown in FIG. 3A, and the lower end openings 21*b* of the respective tablet housing chambers 21 are closed by the upper and lower shutter plates 34, 35. When the start button is selected, the discharging member 36 moves in a left direction (column direction) in FIG. 3A. One end of the discharging member 36 is hooked onto the engaging section 35*a* of the lower shutter plate 35, resulting in that the lower shutter plate 35 also moves in the left direction along with the discharging member 36. Further movement of the discharging member 36 in the left direction in the figure causes that the one end of the discharging member 36 is hooked onto the engaging section 34*a* of the upper shutter plate 34 through the engaging section 35*a* of the lower shutter plate 35, resulting in that the upper shutter plate 34 also moves in the left direction along with the discharging member 36. With the movement, the tablet passage holes 41, 41 in the upper and lower shutter plates 34, 35 come to the open position where the holes are respectively opposed to the lower end openings 21*b* of the respective tablet housing chambers 21 as shown in FIG. 3B. Further, the openings on the upper end side of the tablet discharging chambers 42 of the discharging member 36 become a state of being respectively opposed to the respective lower end openings 21*b*. As a result, the tablets for each one dose which are housed in the respective tablet housing chambers 21 are housed into the tablet discharging chambers 42 of the discharging member 36 passing through the lower end openings 21*b* and the tablet passage holes 41. Next, the discharging member 36 moves in a right direction in the figure, resulting in that the bottom plates 43 of the tablet discharging chambers 42 sequentially reach a portion ahead of the stages 37*a* to 37*d* starting from the tablet discharging chamber on the front side in a moving direction so that support from the lower side is eliminated and the bottom plates are opened. As a result, the tablets inside the respective tablet discharging chambers 42 are sequentially supplied into the hopper 67.

(Powdered Medicine Supply Unit)

The powdered medicine supply unit 3 is manually supplied with the powdered medicine, automatically divides the powdered medicine for each dosage, and sequentially supplies the medicine to the packaging unit 4.

With reference to FIG. 1, the powdered medicine supply unit 3 includes a long chamber that is open to the upper surface of the housing 6 and has a roughly V-shaped section (V-chamber 51). The bottom section of the V-chamber 51 is openable and closable. Further, a plurality of dividing containers (not shown) is arranged below the V-chamber 51. When the bottom sections are opened, the powdered medicine fed into the V-chamber 51 drops into the dividing containers to be divided into a predetermined amount. The bottom sections of the dividing containers are also openable and closable. By sequentially opening the bottom sections of the dividing containers, the powdered medicines inside the respective dividing containers drop into the hopper 67, and are supplied to the packaging unit 4 one-by-one dose. Further, a movable partitioning plate 52 for adjusting the number of powdered medicine to be divided is arranged in the V-chamber 51. The configuration of the powdered medicine supply unit 3 is not particularly limited so long as the powdered medicine can be supplied to the packaging unit 4 one-by-one dose. For example, the powdered medicine supply unit 3 may have a distribution plate with an outer peripheral circular groove to which the powdered medicine is fed from a hopper, and a scraping-out device sequentially scrapes out the powdered medicine one-by-one dose from the outer peripheral circular groove to sequentially supply them to the packaging unit 4.

(Packaging Unit)

In the following, the packaging unit 4 is described with reference to FIGS. 6 to 22. The packaging unit 4 is provided with a sheet supply section 63, an unfolding guide 65, a hopper 67, a heat sealing section 68, and a printing section 69. The sheet supply section 63 rolls out and feeds a long and narrow package sheet 61 previously folded into two portions along with the longitudinal direction from a roll 62 on which the package sheet 61 is wound. The unfolding guide 65 unfolds and opens the two-folded package sheet 61 fed from the sheet supply section 63. The hopper 67 has an inlet opening 67*b* into which the medicine is fed from the tablet supply unit 2 and the powdered medicine supply unit 3 in its upper end, and is equipped with a nozzle section 67*a* which functions as a feed port for introducing the medicine into the opening of the two-folded package sheet 61 in its lower end. The heat sealing section 68 seals the package sheet 61 so as to enclose the introduced medicine, by which continuous medicine bags are prepared. The continuous medicine bags prepared by the heat sealing section 68 are cut off by a cutter mechanism (schematically shown by the reference sign 80 only in FIGS. 37 and 38) so as to be divided into each dose. The divided medicine bags are discharged from the medicine discharge section 5 (see FIG. 1). The printing section 69 is placed between the sheet supply section 63 and the unfolding guide 65 along the path of the package sheet 61 to print information including a name of patient, a medicine name, and directions for use, onto the package sheet 61. As mentioned above, the operation of the packaging unit 4 is controlled by the controller 13.

With reference to FIGS. 6 to 10, the packaging unit 4 is provided in a holding frame 71 arranged in the housing space 7 of the housing 6. The holding frame 71 includes a front holding section 71*a* extending on the front side of the housing 6, a side holding section 71*b* extending from the right side to a rear side seen from the front side of the front holding section 71*a*, and a hinge mechanism 72 rotatably connecting the side-end side on the left side seen from the front side of the front holding section 71*a* to the housing 6 (further refer to FIGS. 11 and 12). Such a configuration achieves favorable operability as described later in detail, while allowing compact housing of the packaging unit 4 inside the housing 6. A base plate (not shown) is provided at a position immediately above the top of the holding frame 71 (refer to FIG. 8), and the tablet supply unit 2 and the powdered medicine supply unit 3 are arranged on this base plate. As seen from the above, providing the packaging unit 4 on the holding frame 71 enables compact housing of the packaging unit 4 inside the housing 6 having a limited vertical space.

The roll 62 for the package sheet 61 is arranged in a lower region of the side holding section 71*b* of the holding frame 71. Further, the side holding section 71*b* of the holding frame 71 is provided with two guide rollers 73*a*, 73*b* that constitute part of the sheet supply section 63. A rotational center of the roll 62 and the guide rollers 73*a*, 73*b* extends in the direction substantially orthogonal to the side holding section 71*b* (direction in which the front holding section 71*a* extends). Further, the printing section 69 is arranged above the guide rollers 73*a*, 73*b* of the side holding section 71*b* of the holding frame 71. The package sheet 61 is wound off from the roll 62 to the rear side, horizontally folded by the one guide roller 73*a* to the front side, and further diverted upward by the other guide roller 73*b* to be guided to the printing section 69. A collar-like section may be provided at the tip of the guide rollers 73*a*, 73*b* for preventing meandering and fallout of the package sheet 61.

The printing section 69 includes a replaceable ink cartridge 76 having a winding-off roller and a winding-up roller for a thermal transfer ink ribbon 75, a biasing roller 77 that applies tension to the ink ribbon 75, a thermal transfer head 78, and a backup roller 79 for closely contacting the package sheet 61 to the ink ribbon 75 in a portion of the thermal transfer head 78.

In a portion on the upper side of the front holding section 71*a* of the holding frame 71 and on the right end side seen from the front side, rotatable curvature guide rollers 81A, 81B (curvature guides) are placed which curve the conveying direction of the package sheet 61 which passed the printing section 69 just before the unfolding guide 65 (see FIG. 22 for reference). More specifically, the curvature guide rollers 81A, 81B curve the conveying direction of the package sheet 61, which travels from the back side to the front side along with the side holding section 71*b*, toward the front side of the front holding section 71*a*, and guide the package sheet 61 to diagonally leftward and downward as seen from the front side of the front holding section 71*a*. The curvature guide rollers 81A, 81B extend from the front holding section 71*a* to the direction in which the front holding section 71*a* stretches and also to the direction slantingly downward. As most clearly shown in FIGS. 6, 9, and 22, the direction in which a side edge of the curvature guide roller 81B among the curvature guide rollers 81A, 81B extends on the downstream side of the conveying direction of the package sheet 61 (a chain double-dashed line C) is aligned with the direction in which a later-described main ridge 94 of the unfolding guide 65 extends.

The unfolding guide 65 is placed on the front holding section 71*a* of the holding frame 71 on the left oblique downward side of the curvature guide rollers 81A, 81B as seen from the front (on the downstream side of the conveying direction of the package sheet 61). The unfolding guide 65 is described in detail later. The hopper 67 is held on the front holding section 71*a* of the holding frame 71, and the nozzle section 67*a* on the lower end of the hopper 67 is positioned on the left oblique downward side of the unfolding guide 65 as seen from the front (on the downstream side of the conveying direction of the package sheet 61). Further on the front holding section 71*a* of the holding frame 71, the heat sealing section 68 is placed in an oblique downward position from the nozzle section 67*a* of the hopper 67 as seen from the front (on the downstream side of the conveying direction of the package sheet 61). Since the conveying direction of the package sheet 61 is radically curved by the curvature guide rollers 81A, 81B on the upstream side of the conveying direction of the package sheet 61 with respect to the heat sealing section 68, the printing section 69 is placed on the side holding section 71*b* of the holding frame 71 while the unfolding guide 65, the nozzle section 67*a* of the hopper 67, and the heat sealing section 68 are placed on the front holding section 71*a* of the holding frame 71, so that the printing section 69, the unfolding guide 65, the nozzle section 67*a*, and the heat sealing section 69 can be placed in the vicinity of each other in relatively narrow space.

With reference to FIGS. 6 and 9, the heat sealing section 68 includes a pair of feed rollers 82*a*, 82*b* which is intermittently rotatably driven by a driving mechanism (not shown) including a motor, a direct driven gear, an intermittent gear, and the like. The package sheet 61 is sandwiched between the feed rollers 82*a*, 82*b*, and carried by intermittent rotation of the feed rollers 82*a*, 82*b*. Further, a pair of heater rollers 83*a*, 83*b* is provided on the upstream side of the carrying direction of the package sheet 61 with respect to the feed rollers 82*a*, 82*b*. Each of the heater rollers 83*a*, 83*b* has a disk-shaped feed heat sealing member 84, and a thin rectangular plate-shaped longitudinal heat sealing member 86 formed on the bottom integrally with a roller member 85 having the same diameter as that of the feed heat sealing member 84. The feed heat sealing members 84, 84 are rotatably driven by a driving mechanism (not shown) including the common motor with the motor for the feed rollers 82*a*, 82*b*. The longitudinal heat sealing members 86, 86 are rotatably driven by a driving mechanism different from the mechanism for the feed heat sealing members 84, 84. A longitudinal seal (horizontal seal) is formed at the side edge of the package sheet 61 between the feed heat sealing members 84, 84 of both the heater rollers 83*a*, 83*b*. A seal across the package sheet 61 (vertical seal) is formed by the longitudinal heat sealing members 86, 86 of both the heater rollers 83*a*, 83*b*.

Also with reference to FIGS. 13 to 22, the unfolding guide 65 is described in detail. The unfolding guide 65 is provided with a guide main body 91 having a function to unfold the two-folded package sheet 61 and to form an opening 101 for inserting the nozzle section 67*a* of the hopper 67, and a long and narrow plate-shaped attaching section 93 for fixing the guide main body 91 to the front holding section 71*a* of the holding frame 71 via a bracket 92 (see FIGS. 6 to 8). The unfolding guide 65 is screwed to the bracket 92 with screws (not shown) inserted into through holes 93*a*, 93*b* of the attaching section 93, respectively.

The guide main body 91 of the unfolding guide 65 has the main ridge 94 extending along with a crease 61*a* of the package sheet 61, a pair of unfolding guide surfaces 95*a*, 95*b* which are convex curved surfaces stretching from the main ridge 94 seen from the conveying direction (see arrow A in FIGS. 13, 18, and 22) of the package sheet 61, a sub ridge 90 extending from an end section 94*a* of the main ridge 94 on the upstream side of the conveying direction A of the package sheet 61 to the upstream side of the conveying direction A continuously from the main ridge 94, a pair of top surfaces 96*a*, 96*b* which are convex curved surfaces stretching from the sub ridge 90 seen from the upstream side of the conveying direction A of the package sheet 61, and rear end edges 97*a*, 97*b* sequentially extending from the upstream side of the conveying direction A of the package sheet 61 to the downstream side toward the main ridge 94 and connected to an end section 94*b* of the main ridge 94 on the downstream side of the conveying direction A.

With reference to FIG. 13, as seen from the arrow B direction (front side) orthogonal to the conveying direction A of the package sheet 61 and facing the main ridge 94, the guide main body 91 is generally a smooth curved surface which becomes narrower toward the downstream side of the conveying direction A of the package sheet 61 (widened toward the upstream side of the conveying direction A of the package sheet 61). Contrary to this, with reference to FIG. 14, the guide main body 91 seen from the rear side has recessed shape or hollow shape, and this hollow section is closed by a closing plate 98 schematically shown only in FIG. 21 so as to prevent the medicine (powdered medicine in particular) from stagnating.

The unfolding guide surfaces 95*a*, 95*b* are provided with shoulder sections 99*a*, 99*b* on the top of the conveying direction A of the package sheet 61. The unfolding guide surfaces 95*a*, 95*b* are smoothly connected to the top surfaces 96*a*, 96*b* at the shoulder sections 99*a*, 99*b*. In the present embodiment, the shoulder sections 99*a*, 99*b* of the unfolding guide surfaces 95*a*, 95*b* have thin ridge shape. In the following, the unfolding guide surfaces 95*a*, 95*b* will indicate portions of the unfolding guide surfaces 95*a*, 95*b* excluding the shoulder sections 99*a*, 99*b* unless otherwise specified.

As seen from the conveying direction A of the package sheet 61, an outline of the unfolding guide surfaces 95*a*, 95*b* is a convex curve, and a distance between the pair of unfolding guide surfaces 95*a*, 95*b* is widened as they are farther away from the main ridge 94 (see FIGS. 17, 19, and 20). As seen from the direction orthogonal to the conveying direction A of the package sheet and facing the main ridge 94 (see arrow B in FIGS. 13, 18, and 22), the outline of the unfolding guide surfaces 95*a*, 95*b* is generally linear or straight, and the distance between the unfolding guide surfaces 95*a*, 95*b* gradually becomes narrower from the upstream side to the downstream side of the conveying direction A of the package sheet 61 (see FIG. 15).

The unfolding guide 65 is provided with the pair of unfolding guide surfaces 95*a*, 95*b* which are convex curved surfaces, and the direction in which the side edge of the curvature guide roller 81B among the curvature guide rollers 81A, 81B extends on the downstream side of the conveying direction A of the package sheet 61 (chain double-dashed line C in FIGS. 6, 9, and 22) is aligned with the direction in which the main ridge 94 of the unfolding guide 65 extends. In other words, the direction in which the side edge of the curvature guide roller 81B extends (chain double-dashed line C) and the direction in which the main ridge 94 extends are on an identical plane stretching in the vertical direction. With the configuration of the unfolding guide surfaces 95*a*, 95*b* and the main ridge 94, the two-folded package sheet 61 is guided with the curved surfaces and is thereby gently deformed or unfolded, so that the tension can be equally applied to both the two portions of the two-folded package sheet 61 while the opening 101 can be formed. Therefore, even if the printing section 69, the unfolding guide 65, the nozzle section 67*a* of the hopper 67, and the heat sealing section 68 are placed in the vicinity of each other, it becomes possible to reliably prevent wrinkles from being generated on the package sheet 61 in the heat sealing section 68. In other words, the shape of the unfolding guide 65 can reduce a distance from the printing section 69 to the heat sealing section 68 without generating the wrinkles on the package sheet 61. As a result, a length of the useless package sheet 61 used only for routing upon the initial startup of the medicine packaging apparatus 1 or at the time of replacement of the roll 62 and not for packaging of the medicine (package sheet from the printing section to the heat sealing section) can be reduced to the minimum, and running cost reduction can be achieved thereby. Moreover, downsizing of the device can be attained by reducing the distance from the printing section 69 to the heat sealing section 68.

The reference sign 100*a* in FIG. 15 denotes a contact start position with the package sheet 61 (a portion 61*b* on the left side of the crease 61*a* in FIG. 13) of the unfolding guide surface 95*a* located on the outer side of a curve in the conveying direction A relative to the main ridge 94 as seen from the direction orthogonal to the conveying direction A of the package sheet 61 and facing the main ridge 94 (arrow B in FIGS. 13, 18, and 22). The reference sign 100*b* in FIG. 15 denotes a contact start position with the package sheet 61 (a portion 61*c* on the right side of the crease 61*a* in FIG. 13) of the unfolding guide surface 95*b* located on the inner side of the curve in the conveying direction A relative to the main ridge 94 as seen from the direction of the arrow B. The contact start positions 100*a*, 100*b* are positioned on the shoulder sections 99*a*, 99*b* among the unfolding guide surfaces 95*a*, 95*b*. In FIG. 15, the contact start position 100*a* of the unfolding guide surface 95*a* on the outer side of the curve in the conveying direction A is positioned above the contact start position 100*b* of the unfolding guide surface 95*b* on the inner side of the curve in the conveying direction A. That is, the contact start position 100*a* on the outer side of the curve in the conveying direction A is positioned slightly on the upstream side of the conveying direction A relative to the contact start position 100*b* on the inner side of the curve.

By setting of the contact start positions 100*a*, 100*b*, the portion 61*b* of the two-folded package sheet 61 on the outer side of the curve and the portion 61*c* on the inner side of the curve start to come into contact with the corresponding unfolding guide surfaces 95*a*, 95*b* at the same time. As a result, the two-folded package sheet 61 can be more smoothly unfolded so that the opening 101 can be formed, and it becomes possible to more reliably prevent the wrinkles from being generated on the package sheet 61 in the heat sealing section 68.

The unfolding guide surfaces 95*a*, 95*b* in the present embodiment are not curved surfaces without concave and convex (geometrically continuous curved surfaces) but have fine concave and convex as described in detail later.

With reference to FIG. 18, with respect to the unfolding guide surfaces 95*a*, 95*b* (upstream portions 102*a*, 102*b*) in an area a1 from the shoulder sections 99*a*, 99*b* including the contact start positions 100*a*, 100*b* to positions spaced from the shoulder sections to some extent on the downstream side of the conveying direction A, an area a2 adjacent to the area a1 within a certain range further on the downstream side of the conveying direction A (end section 94*b* of the main ridge 94 on the downstream side) is slightly recessed. That is, intermediate concave sections (first concave sections) 103*a*, 103*b* are formed in the area a2. The intermediate concave sections 103*a*, 103*b* are formed from positions spaced from the main ridge 94 to the rear end edges 97*a*, 97*b*. In other words, the intermediate concave sections 103*a*, 103*b* are not formed at positions near the main ridge 94 even in portions included in the area a2, but the unfolding guide surfaces 95*a*, 95*b* are bulged at the same level as the area a1 (upstream portions 102*a*, 102*b*) at the positions even in the area a2. Further, the intermediate concave sections 103*a*, 103*b* are the relatively radical concave shape with respect to the upstream portions 102*a*, 102*b*, and stages 104*a*, 104*b* are formed between the upstream portions 102*a*, 102*b* and the intermediate concave sections 103*a*, 103*b*.

When the medicine is introduced into the opening 101 of the two-folded package sheet 61 from the nozzle section 67*a* of the hopper 67 on the downstream side of the unfolding guide 65, the two-folded package sheet 61 is bulged in accordance with the volume of the medicine (a distance between the two portions 61*b*, 61*c* which sandwich the crease 61*a* of the two-folded package sheet 61 is stretched). Particularly when the volume of the medicine to be introduced is large, the bulge of this package sheet 61 is notable. With the intermediate concave sections 103*a*, 103*b* provided in the unfolding guide surfaces 95*a*, 95*b*, when the package sheet 61 is bulged in accordance with the introduction of the medicine, the two portions 61*b*, 61*c* of the package sheet 61 come into close contact with the intermediate concave sections 103*a*, 103*b* of the corresponding unfolding guide surfaces 95*a*, 95*b*, and an amount of the package sheet 61 corresponding to this close contact is fed to a portion on the downstream side of the unfolding guide 65 into which the medicine is introduced. Accordingly, by providing the intermediate concave sections 103*a*, 103*b* in the unfolding guide surfaces 95*a*, 95*b*, even when the bulge is generated in accordance with the introduction of the medicine, it becomes possible to prevent excessive tension applied to the package sheet 61. As a result, it becomes possible to more reliably prevent the wrinkles from being generated on the package sheet 61 in the heat sealing section 68. In other words, with the intermediate concave sections 103*a*, 103*b* provided in the unfolding guide surfaces 95*a*, 95*b*, the package sheet 61 can be unfolded in a state that some margins are left for the bulge of the package sheet 61 in accordance with the introduction of the medicine (a state that the bulge can be "absorbed"), so that the opening 101 can be formed. Thereby, it becomes possible to more reliably prevent the wrinkles from being generated in the heat sealing section 68. Since the package sheet 61 has the margins for the bulge due to the intermediate concave sections 103*a*, 103*b*, the package sheet 61 can ease a shock received from the medicine introduced from the nozzle section 67*a* of the hopper 67. By this shock easing, it becomes possible to prevent the medicine (powdered medicine in particular) from being blown up in the two-folded package sheet 61.

If the entire unfolding guide surfaces 95*a*, 95*b* are formed in the same shape as the intermediate concave sections 103*a*, 103*b*, the two portions 61*b*, 61*c* of the package sheet 61 cannot be sufficiently unfolded with respect to the crease 61*a* in portions near the contact start positions 100*a*, 100*b*, that is, the upstream portions 102*a*, 102*b*, and the opening 101 of the size required for the introduction of the medicine from the nozzle section 67*a* of the hopper 67 cannot be secured. However, in the present embodiment, the upstream portions 102*a*, 102*b* are not recessed but the intermediate concave sections 103*a*, 103*b* are partially formed in the unfolding guide surfaces 95*a*, 95*b*. Thus, while securing the opening 101 of the required size, the state that some margins are left for the bulge of the package sheet 61 is realized as described above.

With reference to FIGS. 15 and 18, end concave sections 105*a*, 105*b* made by recessing the unfolding guide surfaces 95*a*, 95*b* more than the intermediate concave sections 103*a*, 103*b* are formed in an area a3 on the downstream side of the area a2 in which the intermediate concave sections 103*a*, 103*b* are formed, the area a3 including the end section 94*b* of the main ridge 94 on the downstream side. Each of the end concave sections 105*a*, 105*b* in the present embodiment is formed by providing a triangle concave 106, a reversed-triangle concave 107, and a square concave 108 in order from the side of the main ridge 94. An area of the end concave section 105*a* of the unfolding guide surface 95*a* located on the outer side of the curve in the conveying direction A relative to the main ridge 94 is set to be larger than an area of the end concave section 105*b* of the unfolding guide surface 95*b* located on the inner side of the curve in the conveying direction A relative to the main ridge 94.

When the package sheet 61 is bulged in accordance with the introduction of the medicine from the nozzle section 67*a* of the hopper 67 into the opening 101 as described above, the respective portions 61*b*, 61*c* of the two-folded package sheet 61 come into close contact with the end concave sections 105*a*, 105*b* of the corresponding unfolding guide surfaces 95*a*, 95*b*, and an amount of the package sheet 61 corresponding to this close contact is fed to the portion on the downstream side of the unfolding guide 65 into which the medicine is introduced. That is, by providing the end concave sections 105*a*, 105*b* in addition to the intermediate concave sections 103*a*, 103*b*, a margin amount for the bulge of the package sheet 61 in accordance with the introduction of the medicine is increased. Thus, even when the volume of the medicine to be introduced is large, it becomes possible to more reliably prevent excessive tension applied to the package sheet 61, and hence it becomes possible to more reliably prevent the wrinkles from being generated in the heat sealing section 68. By the increase in the margin amount, the shock received from the medicine introduced from the nozzle section 67*a* of the hopper 67 can be more effectively eased. Thus, it becomes possible to more reliably prevent the medicine from being blown up in the two-folded package sheet 61.

Larger tension tends to be applied to the portion 61*b* of the two-folded package sheet 61 on the outer side of the curve than the portion 61*c* on the inner side. When the area of the end concave section 105*a* of the unfolding guide surface 95*a* located on the outer side of the curve is set to be larger than the area of the end concave section 105*b* of the unfolding guide surface 95*b* located on the inner side of the curve, the margin amount for the bulge of the package sheet 61 in accordance with the introduction of the medicine on the outer side of the curve becomes larger than the margin amount on the inner side of the curve. Thus, it becomes possible to more effectively prevent excessive tension applied to the portion 61*b* of the two-folded package sheet 61 on the outer side of the curve due to the bulge of the package sheet 61 by the introduction of the medicine.

As most clearly shown in FIG. 18, an angle θ1 (acute angle) made by the above-mentioned rear end edges 97*a*, 97*b* of the unfolding guide 65 and the main ridge 94 at a joining position with the end section 94*b* of the main ridge 94 on the downstream side is set to be larger than an angle θ2 (acute angle) with respect to the main ridge 94 at regions other than the joining position with the end section 94*b* of the main ridge 94 on the downstream side. In the present embodiment, the angle θ1 is 70° and the angle θ2 is 35°.

With the shape of the rear end edges 97*a*, 97*b* of the unfolding guide surfaces 95*a*, 95*b*, it becomes possible to achieve both prevention of the wrinkles generated on the package sheet 61 and smooth transportation of the package sheet. More specifically, since the angle θ2 between the rear end edges 97*a*, 97*b* and the main ridge 94 is set to be small at the regions other than their joining position, the area of the unfolding guide surfaces 95*a*, 95*b* can be set wide enough to prevent the wrinkles from being generated on the package sheet 61 but not to prevent the transportation of the package sheet 61 by frictional resistance.

A portion of the unfolding guide 65 on the upstream side of the conveying direction A of the package sheet 61 has the sub ridge 90 extending continuously from the main ridge 94 as stated above, and the pair of top surfaces 96*a*, 96*b* which are convex curved surfaces stretching substantially symmetrically with respect to the sub ridge 90. Even when the medicine (powdered medicine in particular) introduced from the nozzle section 67*a* of the hopper 67 descends to the top surfaces 96*a*, 96*b* of the unfolding guide due to blowing-up and the like, the medicine falls into the package sheet 61 without remaining on the top surfaces 96*a*, 96*b* since the top surfaces 96*a*, 96*b* are curved surfaces.

Next, characteristics regarding the arrangement of elements constituting the packaging unit 4 are described. While the roll 62 of the package sheet 61, the guide rollers 73*a*, 73*b*, and the printing section 69 are placed on the side holding section 71*b* of the holding frame 71, the backup roller 79, the guide rod 81, the unfolding guide 65, the hopper 67, and the heat sealing section 68 are placed on the front holding section 71*a*. Therefore, as shown in FIG. 11, the roll 62 of the package sheet 61, the guide rollers 73*a*, 73*b*, the printing section 69, the backup roller 79, the curvature guide roller 81, the unfolding guide 65, the hopper 67, and the heat sealing section 68 can be placed compactly, and the space in the housing space 7 of the housing 6 can be utilized. In other words, downsizing of the medicine packaging apparatus 1 can be achieved. If the holding frame 71 is rotated by the hinge mechanism 72 as shown in FIG. 12, almost all the packaging unit 4 is taken out from the housing 6, and the roll 62 of the package sheet 61 and the printing section 69 can be moved to the front side of the housing 6 to allow easy access and visual inspection from the outside, so that the workability of various works such as replacement of the roll 62 and maintenance of the printing section 69 including replacement of the ink ribbon cartridge 76 is enhanced.

(Second Embodiment)

A second embodiment of the present invention shown in FIGS. 23 to 29 is different from the first embodiment only in the configuration of the unfolding guide 65.

As most clearly shown in FIGS. 23, 25, and 27, in the present embodiment, the shoulder sections 99*a*, 99*b* of the unfolding guide surfaces 95*a*, 95*b* are wide and an area of the top surfaces 96*a*, 96*b* is correspondingly narrow. The unfolding guide surfaces 95*a*, 95*b* excluding the shoulder sections 99*a*, 99*b* are smooth curved surfaces without concave as a whole, and have long and narrow flat sections 109*a*, 109*b* extending along the rear end edges 97*a*, 97*b*.

As in the first embodiment, as seen from the conveying direction A of the package sheet 61, the outline of the unfolding guide surfaces 95*a*, 95*b* excluding the flat sections 109*a*, 109*b* is a convex curve, and the distance between the pair of unfolding guide surfaces 95*a*, 95*b* is widened as they are farther away from the main ridge 94. As seen from the direction orthogonal to the conveying direction A of the package sheet and facing the main ridge 94 (arrow B), the outline of the unfolding guide surfaces 95*a*, 95*b* is generally linear or straight, and the distance between the unfolding guide surfaces 95*a*, 95*b* becomes narrower from the upstream side to the downstream side of the conveying direction A of the package sheet 61.

The unfolding guide 65 is provided with the pair of unfolding guide surfaces 95*a*, 95*b* which are convex curved surfaces. As most clearly shown in FIGS. 6, 9, and 22, the direction in which the side edge of the curvature guide roller 81B among the curvature guide rollers 81A, 81B extends on the downstream side of the conveying direction A of the package sheet 61 (chain double-dashed line C) is aligned with the direction in which the main ridge 94 of the unfolding guide 65 extends. With such configuration of the unfolding guide 65, the two-folded package sheet 61 is guided with the curved surfaces and thereby gently deformed or unfolded while equally applying the tension to the two-folded package sheet 61 so that the opening 101 can be formed. As a result, even if the printing section 69, the unfolding guide 65, the nozzle section 67*a* of the hopper 67, and the heat sealing section 68 are placed in the vicinity of each other (even if the distance from the printing section 69 and the heat sealing section 68 is reduced), it becomes possible to reliably prevent the wrinkles from being generated on the package sheet 61 in the heat sealing section 68.

With reference to FIG. 25, the contact start positions 100*a*, 100*b* with the package sheet 61 of the unfolding guide surfaces 95*a*, 95*b* are included in the shoulder sections 99*a*, 99*b*. As in the first embodiment, the contact start position 100*a* of the unfolding guide surface 95*a* on the outer side of the curve in the conveying direction A is positioned above the contact start position 100*b* of the unfolding guide surface 95*b* on the inner side of the curve in the conveying direction A. That is, the contact start position 100*a* on the outer side of the curve is positioned slightly on the upstream side of the conveying direction A relative to the contact start position 100*b* on the inner side of the curve.

By setting of the contact start positions 100*a*, 100*b*, the portions 61*b*, 61*c* of the two-folded package sheet 61 on the outer side and the inner side of the curve start to come into contact with the corresponding unfolding guide surfaces 95*a*, 95*b* at the same time. As a result, the two-folded package sheet 61 can be more smoothly unfolded so that the opening 101 can be formed, and it becomes possible to more reliably prevent the wrinkles from being generated on the package sheet 61 in the heat sealing section 68.

A bulge amount Pin of the unfolding guide surface 95*b* located on the inner side of the curve in the conveying direction A of the package sheet 61, the bulge amount relative to the main ridge 94 at the contact start position 100*b* of the shoulder section 99*b* is set to be larger than a bulge amount Pout of the unfolding guide surface 95*a* located on the outer side of the curve in the conveying direction relative to the main ridge 94, the bulge amount relative to the main ridge 94 at the contact start position 100*a* of the shoulder section 99*a*. In other words, the unfolding guide surfaces 95*a*, 95*b* are asymmetrical relative to the main ridge 94, and the unfolding guide surface 95*b* located on the inner side of the curve in the conveying direction A of the package sheet 61 is in the shape bulging more than the unfolding guide surface 95*a* located on the outer side of the curve.

The tension applied to the portion 61*c* of the two-folded package sheet 61 on the inner side of the curve in the conveying direction A tends to be weaker than the tension applied to the portion 61*b* on the outer side of the curve. Imbalance of the tension between the inner side and the outer side tends to make the portion 61*c* of the two-folded package sheet 61 on the inner side of the curve slack, and this slacking causes a misaligned state (so-called "edge displacement") of both the edges (so-called "edges") of the two portions 61*b*, 61*c* of the two-folded package sheet 61. The contact resistance of such members as the heat transfer head 78 of the printing section 69 positioned on the upstream side of the unfolding guide 65 and the curvature guide rollers 81A, 81B also tends to promote the imbalance of the tension between the portion 61*c* of the package sheet 61 on the inner side and the portion 61*b* on the outer side.

However, in the unfolding guide 65 of the present embodiment, the unfolding guide surface 95*b* located on the inner side of the curve in the conveying direction A of the package sheet 61 is in the shape bulging more than the unfolding guide surface 95*a* located on the outer side of the curve, so that the tension applied to the package sheet 61 from the main ridge 94, both the shoulder sections 99*a*, 99*b*, and both the unfolding guide surfaces 95*a*, 95*b* is balanced. As a result, the tension uniformly acts on both the portions 61*b*, 61*c* of the two-folded package sheet 61, and therefore the package sheet 61 can be unfolded by the unfolding guide 65 with both the edges aligned (in the state of so-called "edge aligned" state), so that generation of the wrinkles can be prevented more reliably.

A linear projection 110 extending in the direction crossing the main ridge 94 is formed at a position adjacent to the contact start position 100*a* with the package sheet 61 of the unfolding guide surface 95*a* located on the outer side of the curve in the conveying direction A relative to the main ridge 94. As most clearly shown in FIG. 28, the linear projection 110 has one end (an end section on the left side in FIG. 28) positioned in a border between the flat section 109*a* of the unfolding guide surface 95*a* and the portion of the curved surface, and the other end (an end section on the right side in FIG. 28) positioned in an intermediate area between the main ridge 94 and the rear end edge 97*b*. The bulge amount of the unfolding guide surface 95*a* on the outer side of the curve in the conveying direction A relative to the main ridge 94 in the portion of the linear projection 110 is also smaller than the bulge amount Pin of the unfolding guide surface 95*b* on the inner side of the curve relative to the main ridge 94 at the contact start position 100*b*.

Since larger tension tends to be applied to the portion 61*b* of the two-folded package sheet 61 on the outer side of the curve than the portion 61*c* on the inner side, the frictional resistance between the package sheet 61 and the unfolding guide surfaces 95*a*, 95*b* tends to be larger on the outer side of the curve than on the inner side of the curve. By providing the linear projection 110, the portion 61*b* of the two-folded package sheet 61 on the outer side of the curve and the unfolding guide surface 95*a* come into contact with each other mainly at two points including the tip of the linear projection 110 and a portion near the end section 94*b* of the main ridge 94 on the downstream side, so that a contact area between the both can be reduced. Since the frictional resistance between the package sheet 61 and the unfolding guide surface 95*a* is reduced by this reduction of the contact area, the package sheet 61 can be unfolded while being more smoothly fed to the heat sealing section 68. Thereby, it becomes possible to more reliably prevent the wrinkles from being generated in the heat sealing section 68.

By providing the linear projection 110, the portion 61*b* of the package sheet 61 is slightly floating from the unfolding guide surface 95*a* in a region between the linear projection 110 and the portion near the main ridge 94. When the package sheet 61 is bulged in accordance with introduction of the medicine from the nozzle section 67*a* of the hopper 67 into the opening 101, the portion 61*b* of the package sheet 61 in this region comes into close contact with the unfolding guide surface 95*a*, and an amount of the package sheet 61 corresponding to this close contact is fed to the portion on the downstream side of the unfolding guide 65 into which the medicine is introduced. That is, by providing the linear projection 110, the margin amount for the bulge of the package sheet 61 in accordance with the introduction of the medicine is increased. Thus, even when the volume of the medicine to be introduced is large, it becomes possible to more reliably prevent excessive tension applied to the package sheet 61, and hence it becomes possible to more reliably prevent the wrinkles from being generated in the heat sealing section 68.

Other configurational and operational aspects of the second embodiment are similar to those of the first embodiment. The unfolding guide 65 in the first embodiment can also employ the configuration in which the unfolding guide surfaces 65*a*, 65*b* are asymmetrical as in the present embodiment, that is, the configuration in which the bulge amount of the unfolding guide surface 95*b* on the inner side of the curve in the conveying direction A relative to the main ridge 94 at the contact start position 100*b* is set to be larger than the bulge amount of the unfolding guide surface 95*a* on the outer side of the curve relative to the main ridge 94 at the contact start position 100*a*.

(Third Embodiment)

In the following, a third embodiment of the present invention is described with reference to FIGS. 30 to 38. The third embodiment is different from the first embodiment only in the packaging unit 4 of the medicine packaging apparatus 1. In the third embodiment, instead of the curvature guide rollers 81A, 81B, a fixed guide rod 181 is placed (see FIG. 12 in particular). More specifically, the guide rod 181 curves the conveying direction of the package sheet 61, which travels from the back side to the front side along with the side holding section 71*b*, toward the front side of the front holding section 71*a*, and guides the package sheet 61 to diagonally downward as seen from the front side of the front holding section 71*a*. The guide rod 181 extends from the front holding section 71*a* to the direction in which the front holding section 71*a* stretches and also to the direction slantingly downward. The direction in which a side edge of the guide rod 181 extends on the downstream side of the conveying direction of the package sheet 61 is aligned with the direction in which the main ridge 94 of the unfolding guide 65 extends (two directions are on an identical plane). The third embodiment is similar to the first embodiment in the configuration and operation of the tablet supply unit 2, the powdered medicine supply unit 3, and the medicine discharge section 5.

The packaging unit 4 in the present embodiment has a mechanism for preventing the tablets fed from the tablet supply unit 2 to the hopper 67 as well as the powdered medicine fed from the powdered medicine supply unit 3 to the hopper 67 from adhering to a wall surface in the hopper 67 and remaining in the hopper 67 without being fed to the package sheet 61. More specifically, the packaging unit 4 in the present embodiment is provided with a hopper-side vibration applying mechanism 202 for applying vibration to the hopper 67 and an unfolding guide-side vibration applying mechanism 203 for applying the vibration to the unfolding guide 65.

With reference to FIGS. 30 and 33, the hopper 67 in the present embodiment has an inlet opening 67*b* in generally a rectangular shape in plan view, and has four inner inclined wall surfaces 67*c*, 67*d*, 67*e*, and 67*f* extending slantingly downward from the inlet opening 67*b* toward the nozzle section 67*a*. The space surrounded with the inner inclined wall surfaces 67*c* to 67*f* is divided by a partitioning plate section 67*g*. In FIG. 33, the tablets are fed from the tablet supply unit 2 to the space on the left-hand side of the partitioning plate section 67*g*, while the powdered medicine is fed from the powdered medicine supply unit 3 to the space on the right-hand side. In order to secure a wider plan view area of the inlet opening 67*b* for receiving the powdered medicine from the powdered medicine supply unit 3, the inner inclined wall surface 67*c* on the right-hand side of the partitioning plate section 67*g* in FIG. 33 among the four inner inclined wall surfaces 67*c* to 67*f* is set to have an angle of gradient smaller than that of the three remaining inner inclined wall surfaces 67*d* to 67*f*. More specifically, the inner inclined wall surfaces 67*d* to 67*f* have an angle of gradient set at about 75 to 85°, whereas the inner inclined wall surface 67*c* has an angle of gradient set at about 35 to 40°. The inwardly inclined surface 67*e* has an angle of gradient set at 64°.

The hopper 67 in the present embodiment has a held section 67*h* held by a later-described hopper holding section 206 of the hopper-side vibration applying mechanism 202. The held section 67*h* is provided near the inlet opening 67*b* outside the inner inclined wall surface 67*f*. The held section 67*h*, which is in the shape of a long and narrow block having a recess section 67*i* formed on its lower-end side, has an inclined held surface 67*j* formed in one end side (left-hand side in FIG. 33) and a projection 67*k* formed in the other end side. A knob 67*m* for the operator to grasp the hopper 67 is provided near the inlet opening 67*b* outside the inner inclined wall surface 67*d* facing the held section 67*h*.

With reference to FIGS. 30 to 33, the hopper-side vibration applying mechanism 202 has a holding structure 205 made of resin fixed to the holding frame 71 via a bracket 204. The holding structure 205 has the long and narrow hopper holding section 206 extending in the horizontal direction. The hopper 67 is held by the hopper holding section 206 in the posture that the longitudinal direction of the inlet opening 67*b* (direction in which upper edges of the inwardly inclined surfaces 67*d*, 67*f* extend) is identical to the longitudinal direction of the hopper holding section 206 in plan view. In order to removably hold the held section 67*h* of the hopper 67, the hopper holding section 206 has a reversed L-shaped hooking section 206*a* which projects upward in a section rather close to the center than the right end in FIG. 33, and has a locking mechanism 206*b* on the upper side near the left end. The locking mechanism 206*b* has a manipulation lever 206*c* rotatable around a horizontal shaft line (see arrow D). The locking mechanism 206*b* is placed closer to the center of the hopper holding section 206*a* than the manipulation lever 206*c*, and similarly has a locking lever 206*d* rotatable around the horizontal shaft line (see arrow E).

The held section 67*h* of the hopper 67 is removably fixed onto the hopper holding section 206. As shown in FIG. 33, when the hopper 67 is fixed to the hopper holding section 206, the projection 67*k* of the held section 67*h* fits into the lower side of the hooking section 206*a* of the hopper holding section 206, and the held surface 67*j* is pressed by a holding surface 206*g* of the locking lever 206*d*. The locking lever 206*d* is held in an unrotatable state by a fixed section 206*e* on the opposite side of the holding surface 206*g* being engaged with a fixing section 206*f* of the manipulation lever 206*c*. When a knob 206*h* of the manipulation lever 206*c* is operated and is rotated counterclockwise in FIG. 33, the fixing section 206*f* of the manipulation lever 206*c* is released from the fixed section 206*e* of the locking lever 206*d*. As a result, the locking lever 206*d* becomes rotatable and the held surface 67*j* is released from pressing by the holding surface 206*g*, by which the held section 67*h* of the hopper 67 becomes removable from the hopper holding section 206. The configuration for removably mounting the hopper 67 onto the hopper holding section 206 is not limited to the configuration of the present embodiment as long as the hopper 67 can firmly be fixed to the hopper holding section 206 to some degree. For example, the hopper 67 may be removably mounted on the hopper holding section 206 by fixation with magnets, screw clamps and the like.

A vibration motor holding section 207 is provided below a right end section of the hopper holding section 206 in FIG. 33. The vibration motor holding section 207 is provided with a cylindrical main body 207*a* for holding a vibration motor 208 inside and a coupling section 207*b* for coupling the main body 207*a* to the undersurface of the hopper holding section 206. The vibration motor 208 is held in a manner to be hung from the undersurface side of one end of the hopper holding section 206.

Any type of the vibration motor 208 may be used as long as operation start and stop can electrically be controlled at least. The vibration motor 208 used in the present embodiment is a type of the motor having a weight fixed to the rotation shaft of a direct-current motor incorporated in a casing. A later-described vibration motor 211 is also of the same type as the vibration motor 208.

The upper end side of the holding structure 205 is coupled to the hopper holding section 206, while the lower end side has two leaf spring sections 209*a*, 209*b* fixed to the bracket with screws. In plan view, the leaf springs 209*a*, 209*b* extend right under the hopper holding section 206 (vertically downward). In side view, the leaf spring sections 209*a*, 209*b* extend slantingly downward from the hopper holding section 206 in parallel with each other so as to be farther away from the vibration motor holding section 207 (vibration motor 208) toward the lower end side, and are placed in the longitudinal direction of the hopper holding section 206 at an interval. An angle of gradient θ of the leaf spring sections 209*a*, 209*b* with respect to the horizontal direction is set at, for example, around 80°. The leaf spring sections 209*a*, 209*b* sag like a cantilever with the lower end side being a fixed end while the upper end side being a free end, and upon displacement of the upper ends of the leaf spring sections 209*a*, 209*b* due to the sagging, the hopper holding section 206 is also displaced thereby.

Vibration generated by operation of the vibration motor 208 is transmitted to the hopper 67 via the holding structure 205. With the vibration, the tablets fed from the tablet supply unit 2 and the powdered medicine fed from the powdered medicine supply unit 3 promptly move from the inlet opening 67*b* to the nozzle section 67*a* without adhering to the inner inclined wall surfaces 67*c* to 67*f* of the hopper 67, and are introduced into the opening of the two-folded package sheet 61 unfolded by the unfolding guide 65. Therefore, contamination can be eliminated by effectively preventing the medicine (powdered medicine in particular) from adhering to and remaining in the hopper 67. As compared with a sound generated upon striking of the hopper with a solenoid and the like, a sound made by application of the vibration is small in volume and causes neither displeasure of the operator nor false detection of failure by the operator.

As shown with arrow H in FIG. 33, in a plane (plane of paper itself in FIG. 33) including the moving direction F and the gravity direction G of the powdered medicine which moves on the inner inclined wall surface 67*c* which has the mildest inclination, the above-constituted holding structure 205 in the present embodiment transmits the vibration generated by the vibration motor 208 to the hopper 67 so that the hopper 67 may vibrate with an elliptical orbit which is farther away from the inwardly inclined surface 67*c* toward the upper end side. A major axis M of the elliptical orbit H of the vibration of the hopper 67 is perpendicular to the leaf spring sections 209*a*, 209*b* (angle of gradient θ), and an angle $\theta_H$ formed between the major axis M and the moving direction F of the powdered medicine which moves on the inwardly inclined surface 67*c* by its own weight is less than 90 degrees but is relatively large (about 45 degrees or more and less than 90 degrees). Application of the vibration with such elliptical orbit makes it possible to efficiently move the powdered medicine on the inwardly inclined surface 67*c* having mild inclination from the inlet opening 67*b* to the nozzle section 67*a*, and to reliably prevent the residual medicine generated by adhesion. Since the vibration motor 208 is positioned in the vicinity of the upper end of the inwardly inclined surface 67*c*, the vibration generated by the vibration motor 208 is efficiently transmitted to the inwardly inclined surface 67*c* and promotes movement of the medicine on the inwardly inclined surface 67*c*.

With reference to FIGS. 34 and 35, the unfolding guide-side vibration applying mechanism 203 is equipped with the vibration motor (second vibration source) 211 built in the unfolding guide 65. A plurality of radially extending ribs 212 is provided in the unfolding guide 65, and the vibration motor 211 is fixed to the unfolding guide 65 with these ribs 212. Therefore, the vibration generated by the vibration motor 211 is directly transmitted to the unfolding guide 65. Since applying the vibration not only to the hopper 67 but also to the unfolding guide 65 by the unfolding guide-side vibration applying mechanism 203 smoothes the movement or flow of the medicine (powdered medicine in particular) within the two-folded package sheet 61, it becomes possible to more reliably prevent the medicine from adhering to and remaining in the hopper 67.

In the following, control of the hopper-side vibration applying mechanism 202 and the unfolding guide-side vibration applying mechanism 203 by the controller 11 is described. In the present embodiment, the hopper-side vibration applying mechanism 202 and the unfolding guide-side vibration applying mechanism 203 operate in synchronization, so that the hopper-side vibration applying mechanism 202 and the unfolding guide-side vibration applying mechanism 203 operate and stop simultaneously on a constant basis. However, the hopper-side vibration applying mechanism 202 and the unfolding guide-side vibration applying mechanism 203 may operate independently of each other. Unless otherwise required to be distinguished, the hopper-side vibration applying mechanism 202 and the unfolding guide-side vibration applying mechanism 203 are referred to as vibration applying mechanisms 202, 203 in the following description.

First, after the tips of the longitudinal heat sealing members 86, 86 (see, e.g., FIGS. 6, 9) of the heater rollers 83*a*, 83*b* are put in the state of pushing each other to hold the package sheet 61, that is, after the longitudinal heat sealing members 86, 86 are put in a position to form vertical seals, the vibration applying mechanisms 202, 203 start operation after the elapse of a predetermined time. The operation duration of the vibration applying mechanisms 202, 203 is set in response to packing speed. The feed rate of the package sheet 61 with the feed rollers 82*a*, 82*b* (see, e.g., FIGS. 6, 9) is faster in tablet packing than in powdered medicine packing, and therefore, a duration of time from the point that the longitudinal heat sealing members 86, 86 are put in the position to form the vertical seals until the start of operation of the vibration applying mechanisms 202, 203 is set shorter in the tablet packing than in the powdered medicine packing. For both the tablet packing and the powdered medicine packing, the slower the feed rate of the package sheet 61 becomes, the longer the duration of time till the start of the operation of the vibration applying mechanisms 202, 203 is set. In the case where both the powdered medicine and the tablets are included in one prescription (simultaneous packing of tablet and powdered medicine), operation timing and operation duration of the vibration applying mechanisms 202, 203 are set in conformity to the case of the powdered medicine packing.

When one prescription includes both a medicine bag of the tablets and a medicine bag of the powdered medicine (mixed packing), the controller 11 operates the vibration applying mechanisms 202, 203 for the medicine bag of the powdered medicine with use of the timing and operation duration similar to the powdered medicine packing, and operates the vibration applying mechanisms 202, 203 for the medicine bag of the tablets with use of the timing and operation duration similar to the tablet packing. In order to reliably prevent the powdered medicine adhering to and remaining in the hopper 67 from mixing into the medicine bag of the tablets, the controller 11 does not operate the vibration applying mechanisms 202, 203 but keeps them in a stopped state during preparation of the medicine bag of the tablets once the medicine bag of the powdered medicine is completed during mixed packing. FIG. 36 schematically shows the operation of the vibration applying mechanisms 202, 203 during mixed packing. In this example, 3 doses of the medicine are prepared in which the tablets are taken in the "morning" and the "noon", and the powdered medicine is taken in the "evening." A symbol "○" shown below a schematically depicted medicine bag 215 indicates that the vibration applying mechanisms 202, 203 are operated, whereas a symbol "x" indicates that the vibration applying mechanisms 202, 203 are maintained in the stopped state. The first and second medicine bags 215 contain the tablets, and the powdered medicine is not yet packaged in the same prescription. Even though the first and second medicine bags 215 contain the tablets, the vibration applying mechanisms 202, 203 are operated as in the case of the powdered medicine. The third medicine bag 215 is the first medicine bag which packs the powdered medicine within the same prescription, and the vibration applying mechanisms 202, 203 are also operated during preparation of the third medicine bag 215. During preparation of the fourth, fifth, seventh and eighth medicine bags 215 in which the tablets are packed after the third medicine bag, the vibration applying mechanisms 202, 203 are maintained in the stopped state, whereas during preparation of the sixth and ninth medicine bags 215 in which the powdered medicine is packed, the vibration applying mechanisms 202, 203 are operated.

With reference to FIGS. 37 and 38, empty medicine bags (loss bags 216) containing no medicine are provided in order to separate continuous medicine bags by prescription, and the loss bags 216 are cut off by the cutter mechanism 80. If the medicine (powdered medicine in particular) is mixed in the loss bags 216, the mixed medicine flows out into the device upon cutting by the cutter mechanism 80, and thereby causes the contamination. Therefore, once the controller 11 determines that the loss bags 216 are in preparation based on the inputted prescription information, the vibration applying mechanisms 202, 203 are maintained in the stopped state. Since the first loss bag 216 in the example of FIG. 37, and the second loss bag 216 in the example of FIG. 38 are subjected to cutting by the cutter mechanism 80, the vibration applying mechanisms 202, 203 are maintained in the stopped state during preparation of these loss bags 216.

(Fourth Embodiment)

In the following, a fourth embodiment of the present invention is described with reference to FIGS. 39 to 44. The fourth embodiment is different from the third embodiment in the configuration of the held section 67*h* of the hopper 67 and the hopper-side vibration applying mechanism 202.

With reference to FIG. 44, the held section 67*h* of the hopper 67 in the present embodiment has block-shaped first and second portions 67*n*, 67*p* provided near the inlet opening 67*b* outside the inner inclined wall surface 67*f*. An inclined held surface 67*q* is formed in one end side (left-hand side in FIG. 44) of the first section 67*n*, while a projection 67*r* is formed in the other end side. A projection 67*s* is also provided in one end side (right-hand side in FIG. 44) of the second portion 67*p*.

The holding structure 205 included in the hopper-side vibration applying mechanism 202 of the present embodiment has a base 307 independent of the hopper holding section 206. The hopper holding section 206 and the base 307 are coupled to each other with independent leaf springs 308*a*, 308*b* having both upper and lower ends screwed shut. In plan view, the leaf springs 308*a*, 308*b* extend right under the hopper holding section 206 (vertically downward). In side view, the leaf springs 308*a*, 308*b* extend slantingly downward from the hopper holding section 206 in parallel with each other so as to be closer to the vibration motor holding section 207 (vibration motor 208) toward the lower end side, and are placed in the longitudinal direction of the hopper holding section 206 at an interval. An angle of gradient θ of the leaf springs 308*a*, 308*b* with respect to the horizontal direction is set at, for example, around 80°. The leaf springs 308*a*, 308*b* sag like a cantilever with the lower end side being a fixed end while the upper end side being a free end, and upon displacement of the upper ends of the leaf springs 308*a*, 308*b* due to the sagging, the hopper holding section 206 is also displaced thereby.

As shown with arrow H in FIG. 44, in a plane (plane of paper itself in FIG. 44) including the moving direction F and the gravity direction G of the powdered medicine which moves on the inwardly inclined surface 67*c* which has the mildest inclination, the above-constituted holding structure 205 in the present embodiment transmits the vibration generated by the vibration motor 208 to the hopper 67 so that the hopper 67 may vibrate with an elliptical orbit which is farther away from the inwardly inclined surface 67*c* toward the upper end side. The major axis M of the elliptical orbit H of the vibration of the hopper 67 is perpendicular to the leaf springs 308*a*, 308*b* (angle of gradient θ), and the angle $\theta_H$ formed between the major axis H and the moving direction F of the powdered medicine which moves on the inwardly inclined surface 67*c* by its own weight is an acute angle sufficiently smaller than 45 degrees (about 5° to 15°). Application of the vibration with such elliptical orbit makes it possible to efficiently move the powdered medicine on the inwardly inclined surface 67*c* having mild inclination from the inlet opening 67*b* to the nozzle section 67*a*, and to reliably prevent the residual medicine generated by adhesion. As compared with the case where the angle $\theta_H$ is a relatively obtuse angle as in the third embodiment, setting the angle $\theta_H$ to be a sufficiently small acute angle makes it possible to enhance the movement speed of the powdered medicine on the inwardly inclined surface 67*c*. Since the vibration motor 208 is positioned in the vicinity of the upper end of the inwardly inclined surface 67*c*, the vibration generated by the vibration motor 208 is efficiently transmitted to the inwardly inclined surface 67*c* and promotes the movement of the medicine on the inwardly inclined surface 67*c*.

The hopper holding section 206 in the present embodiment has reverse L-shaped hooking sections 306*a*, 306*b* protruding upward. The hopper holding section 206 is equipped with a rotatable lever 306*d* which functions as a locking mechanism 306*c*. As shown in FIG. 44, when the hopper 67 is fixed to the hopper holding section 306, projections 67*r*, 67*s* of the held section 67 fit into the lower side of the hooking sections 306*a*, 306*b*, and the held surface 67*q* is pressed by a holding surface 306*e* of the lever 306*d*. When the lever 306*d* is rotated clockwise in FIG. 44, the holding surface 306*e* of the lever 306*d* is released from the held surface 67*q*, and the hopper 67 becomes removable from the hopper holding section 206.

Other configurational and operational aspects of the fourth embodiment are similar to those of third embodiment. In employing the hopper-side vibration applying mechanism 202 and the unfolding guide-side vibration applying mechanism 203 of the third embodiment, the feeding configuration of the package sheet 61 is not particularly limited. More specifically, the package sheet 61 may be held in the state of being wound around the roll 62 without being folded into two portions, and may be folded into two portions after being rolled out from the roll 62. Although not shown in FIGS. 39 to 44, the unfolding guide-side vibration applying mechanism is housed in the unfolding guide 65 as in the third embodiment.

(Modifications)

In a modified example shown in FIG. 45, three guide rollers 401*a*, 401*b*, 401*c* are provided instead of the two curvature guide rollers 81A, 81B (first and second embodiments) and the guide rod 181 (third and fourth embodiments). The conveying direction of the package sheet 61 is curved just before the unfolding guide 65 with these guide rollers 401*a* to 401*c*. A projection 410 in small-diameter cylinder shape protruding upward is provided on the upper top section of the guide roller 401*a* which is closest to the unfolding guide 65 among the three guide rollers 401*a* to 401*c*. The projection 410 has a function to prevent meandering and fallout of the package sheet 61. Since the conveying direction of the package sheet 61 curves slantingly downward in a portion of the guide roller 401*a*, the projection 410 can effectively prevent the meandering and the fallout of the package sheet 61. Since the peripheral surface of the small-diameter cylinder shape of the projection 410 comes into contact with the package sheet 61, the contact resistance to the package sheet 61 is very small.

Figure 1:
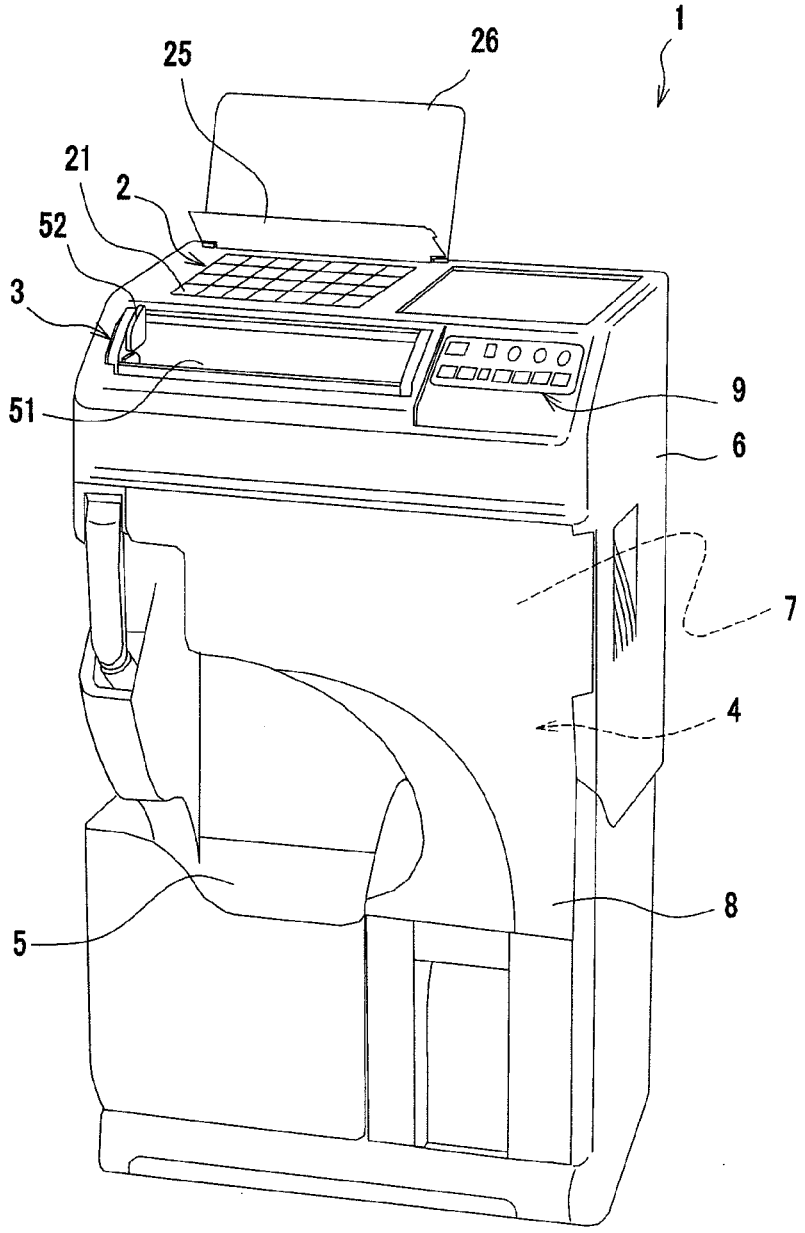
FIG. 1 is a perspective view for showing an outline of a medicine packaging apparatus according to a first embodiment of the present invention from the front side.
Figure 2:
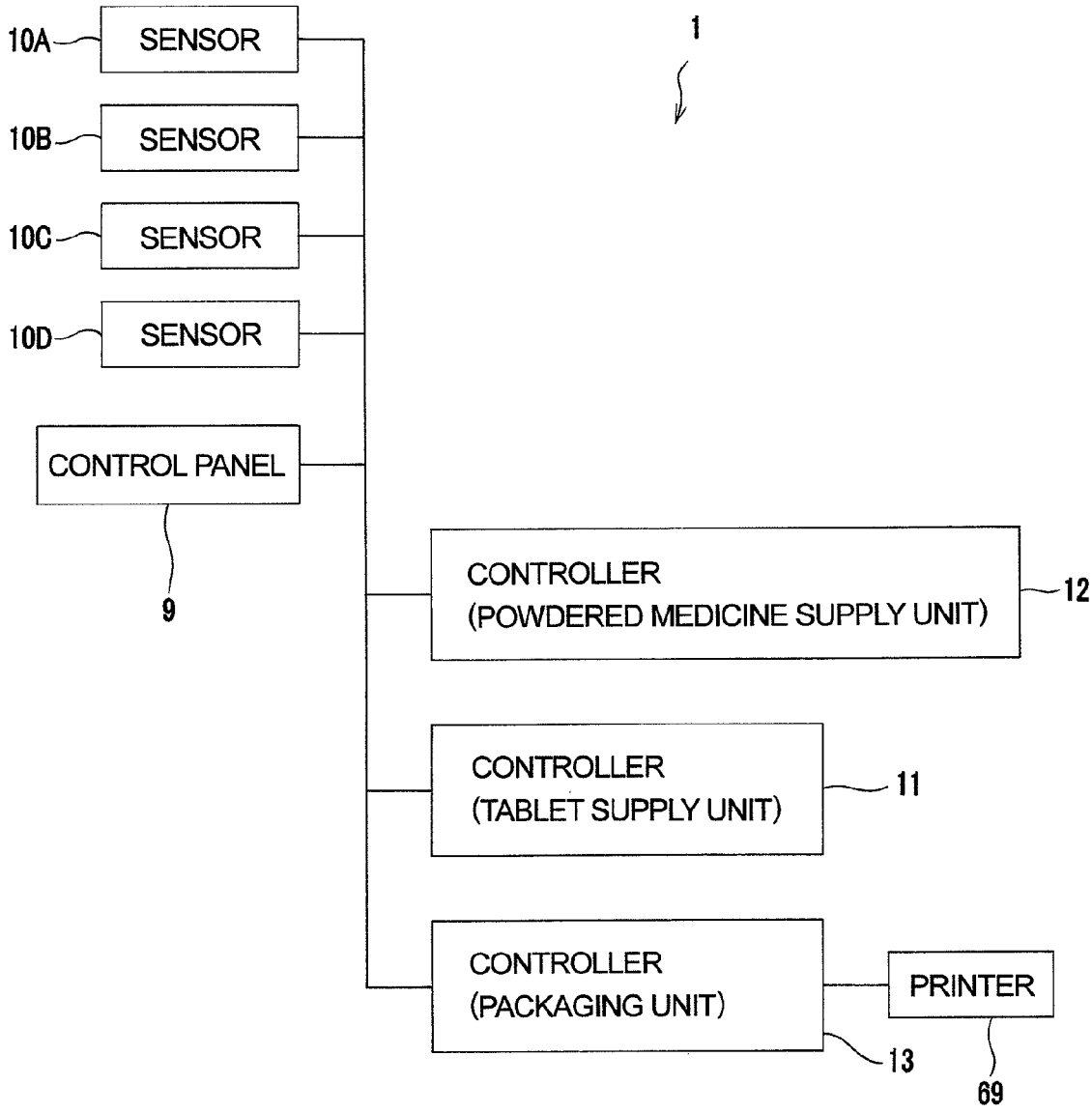
FIG. 2 is a block diagram showing the configuration of the medicine packaging apparatus according to the first embodiment of the present invention.
Figure 3A:
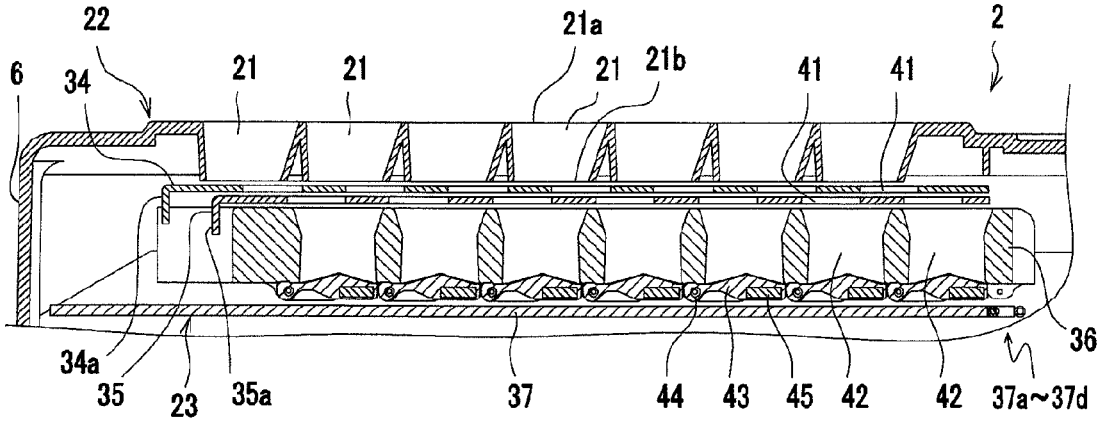
FIG. 3A is a partial sectional view of a tablet supply unit with a shutter closed.
Figure 3B:
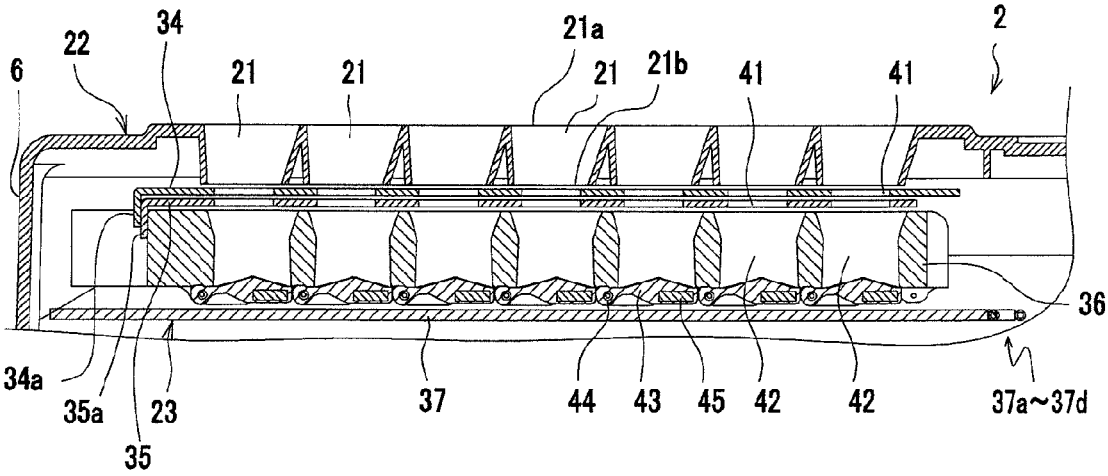
FIG. 3B is a partial sectional view of the tablet supply unit while the shutter being opened.
Figure 4:
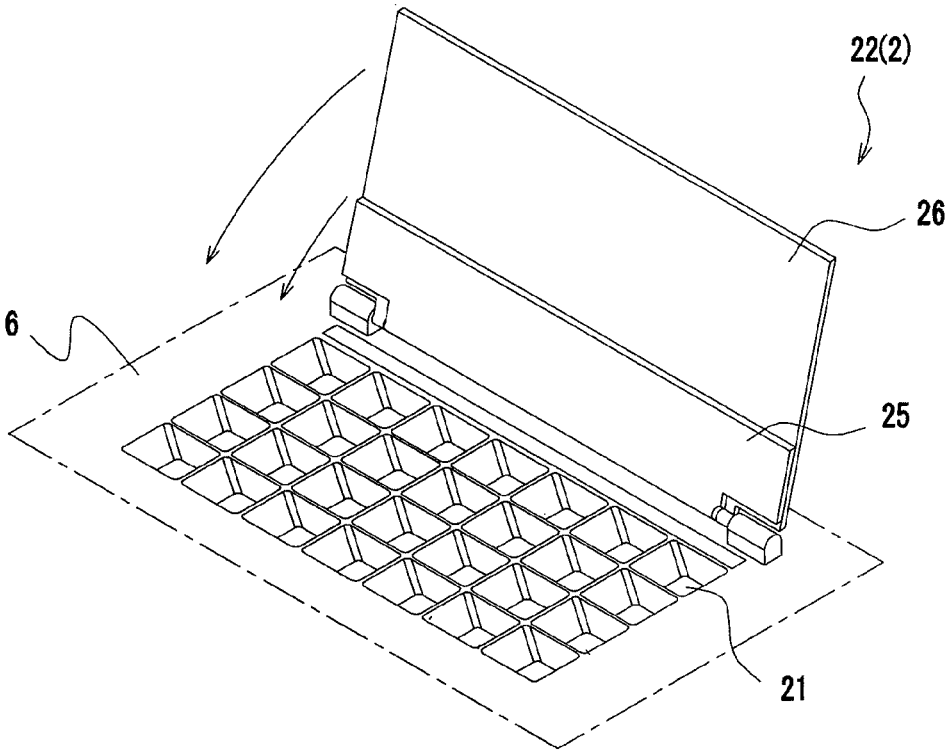
FIG. 4 is a perspective view showing a tablet housing section.
Figure 5:
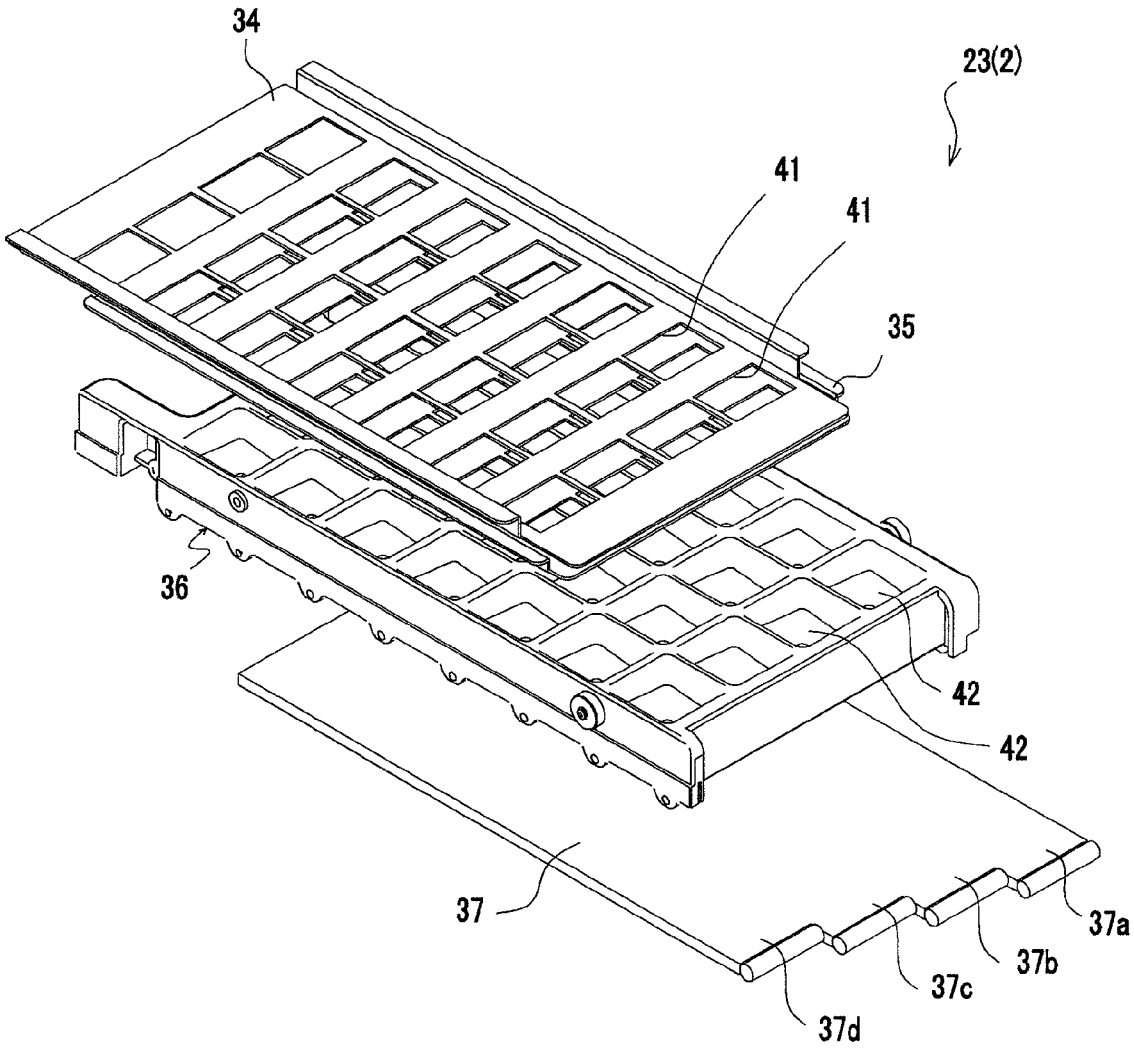
FIG. 5 is an exploded perspective view of a tablet discharging section.
Figure 6:
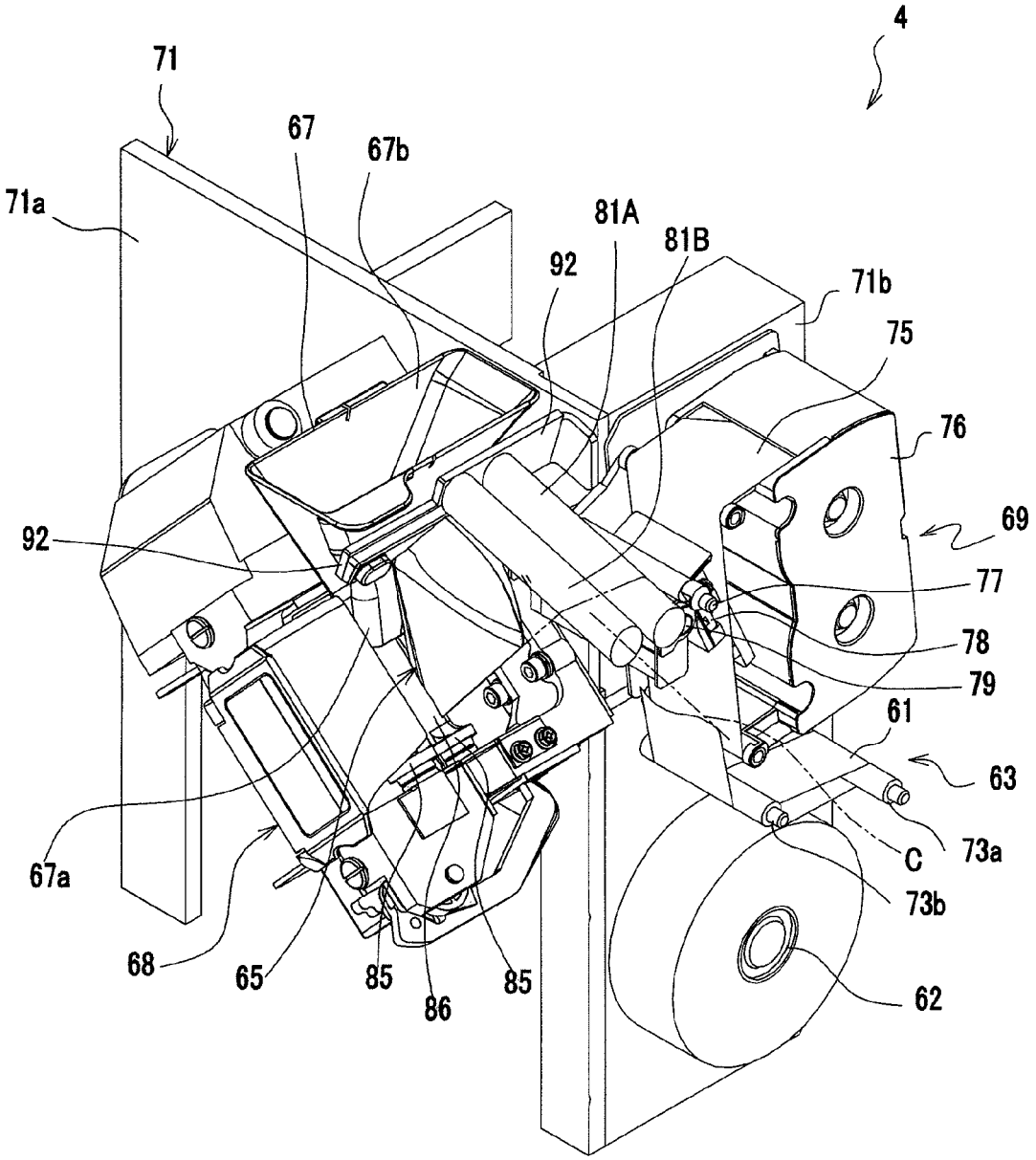
FIG. 6 is a perspective view for showing a packaging unit from the upper lateral side.
Figure 7:
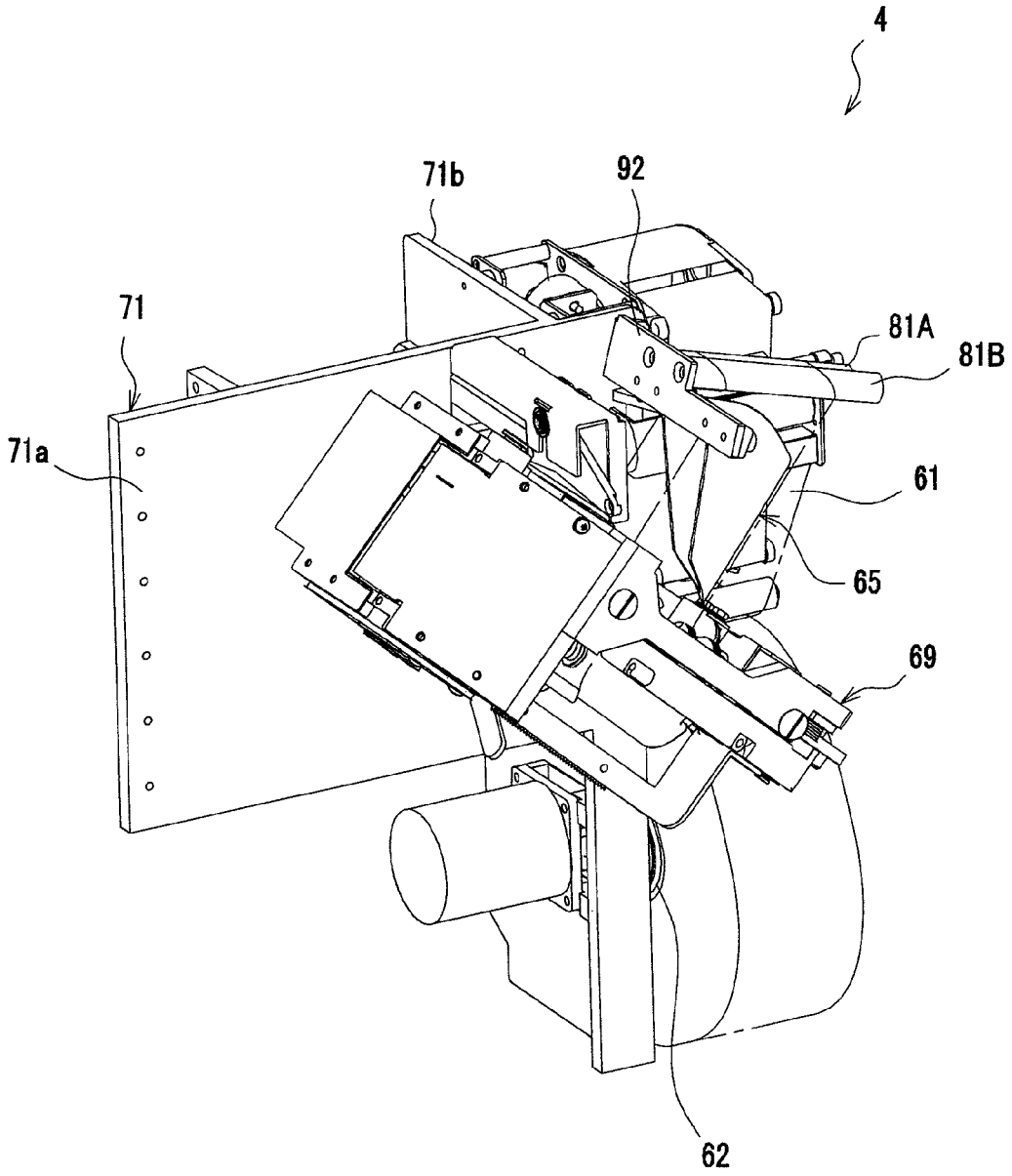
FIG. 7 is a perspective view for showing the packaging unit from the upper front side.
Figure 8:
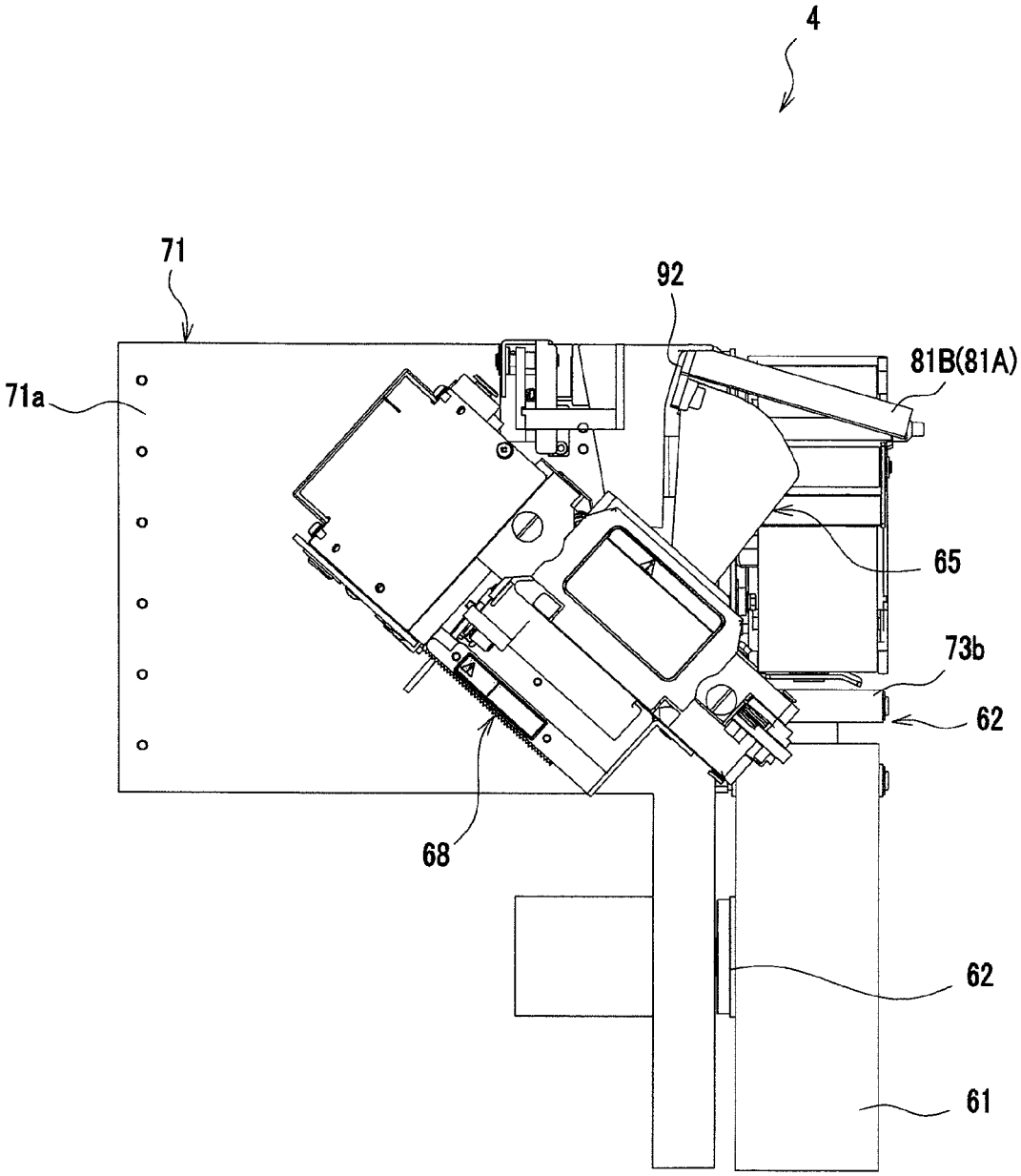
FIG. 8 is a front view of the packaging unit.
Figure 9:
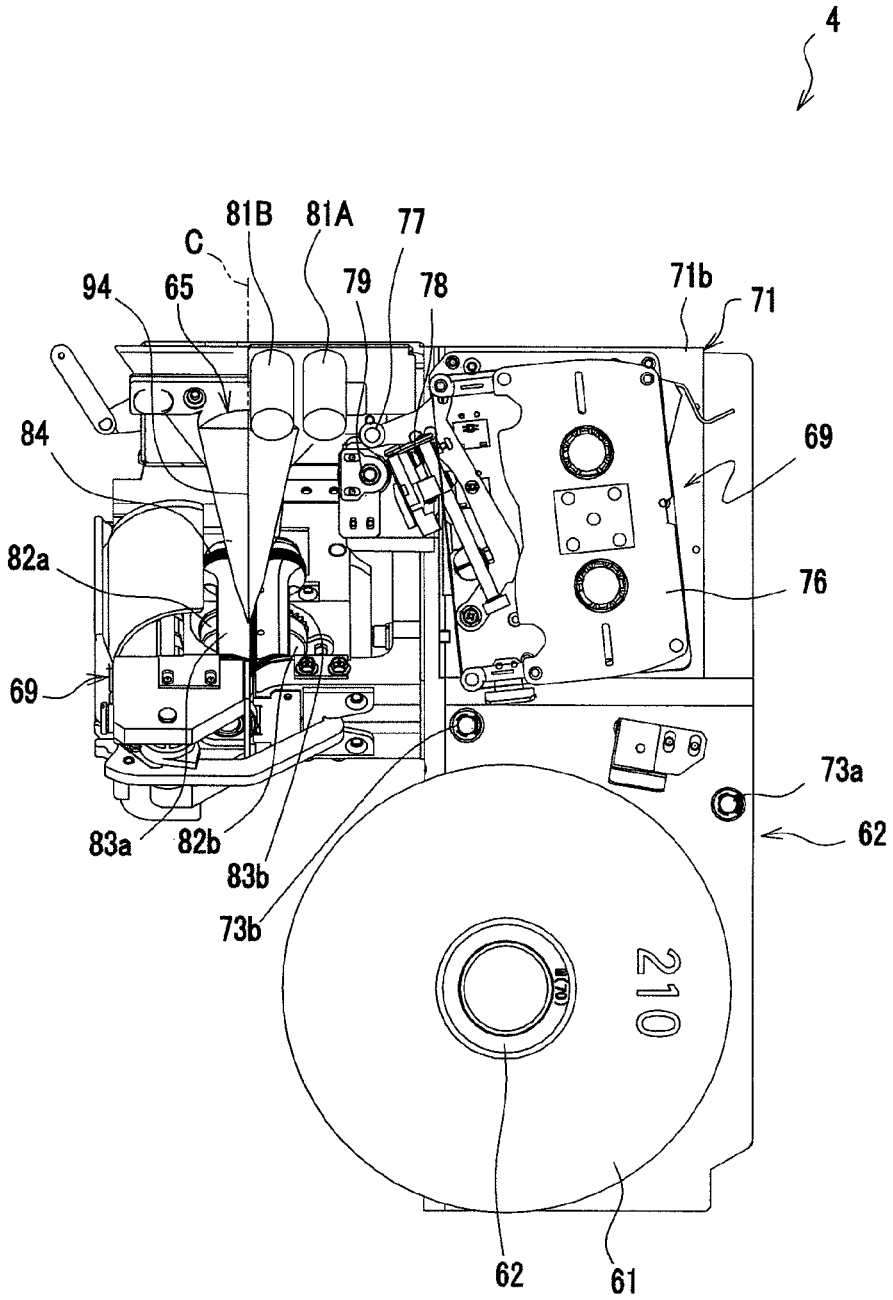
FIG. 9 is a right side view of the packaging unit.
Figure 10:
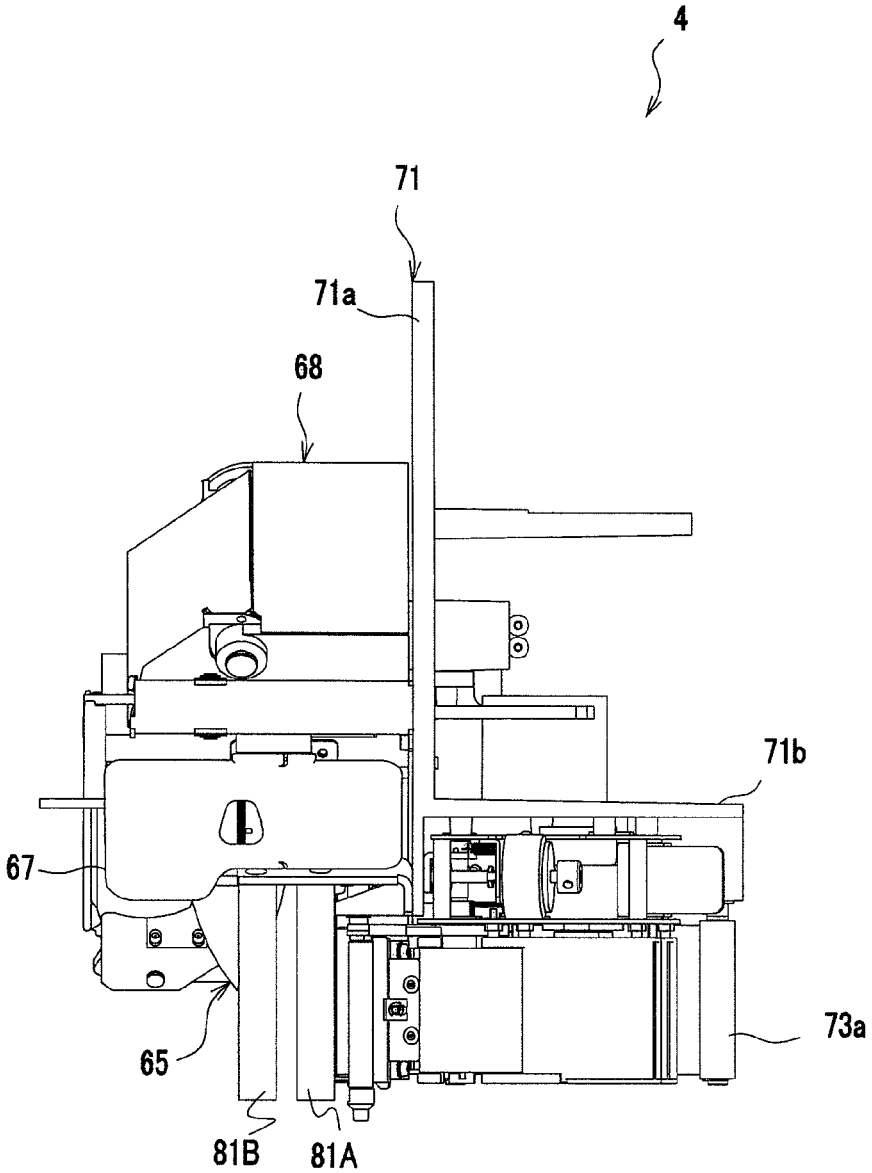
FIG. 10 is a plan view of the packaging unit.
Figure 11:
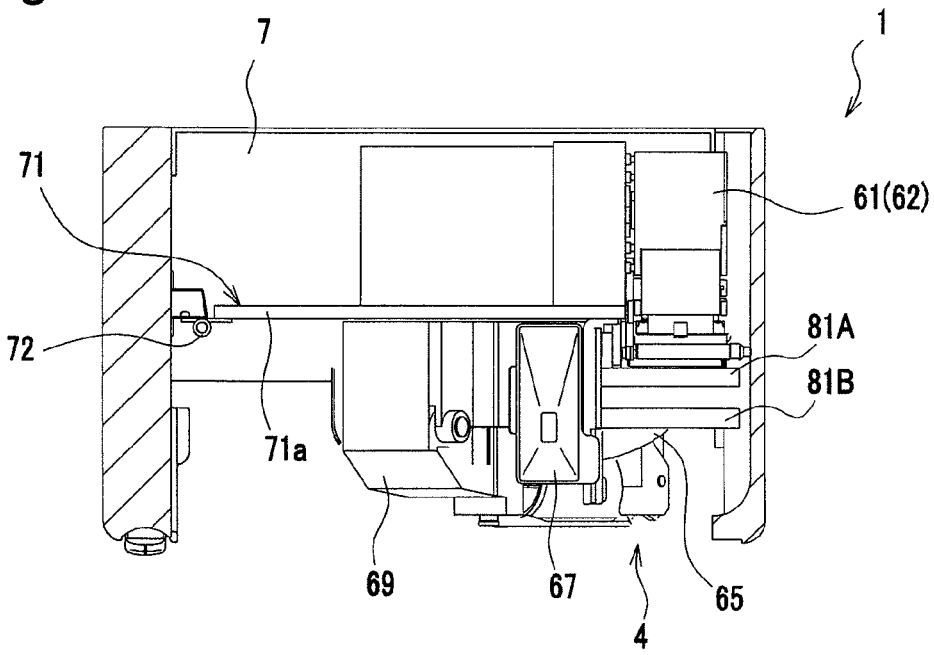
FIG. 11 is a cross sectional view showing the medicine packaging apparatus with the packaging unit at a housing position.
Figure 12:
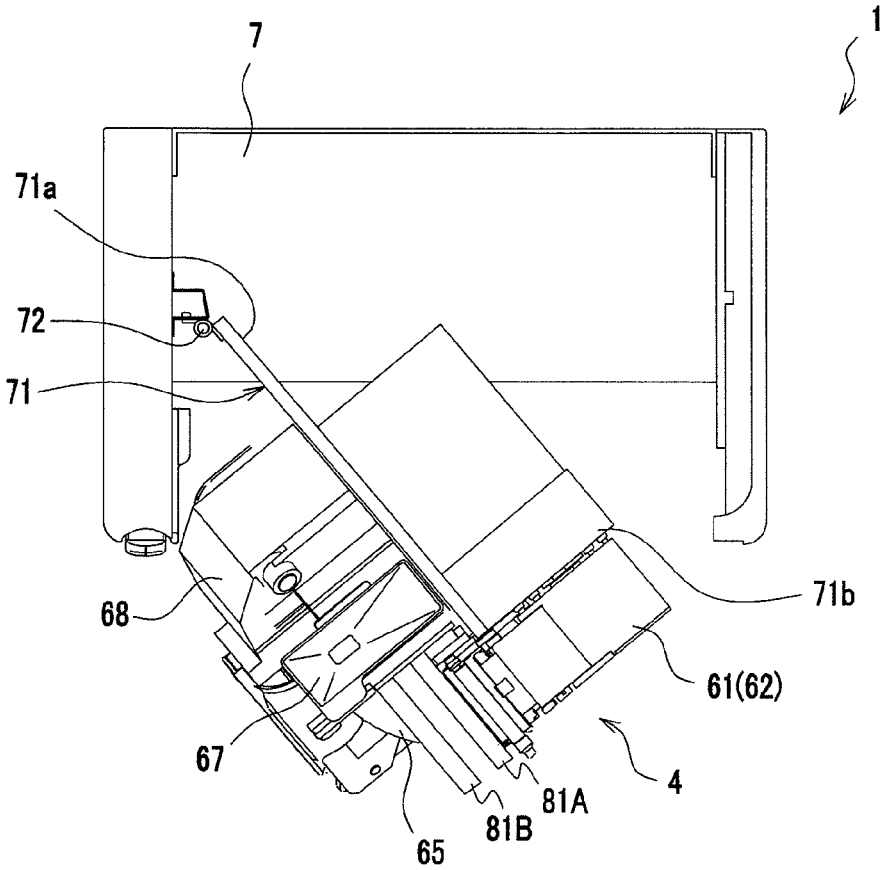
FIG. 12 is a cross sectional view showing the medicine packaging apparatus with the packaging unit at an ejection position.
Figure 13:
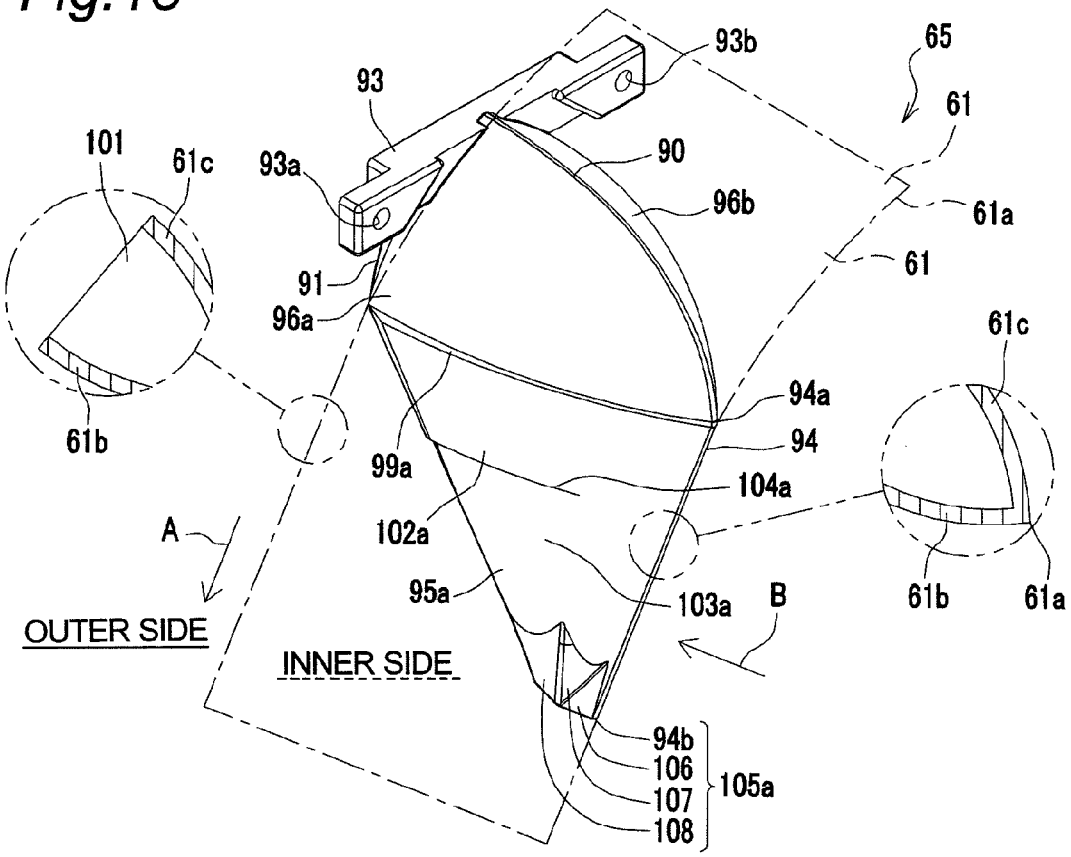
FIG. 13 is a perspective view for showing an unfolding guide of the first embodiment from the front upper side.
Figure 14:
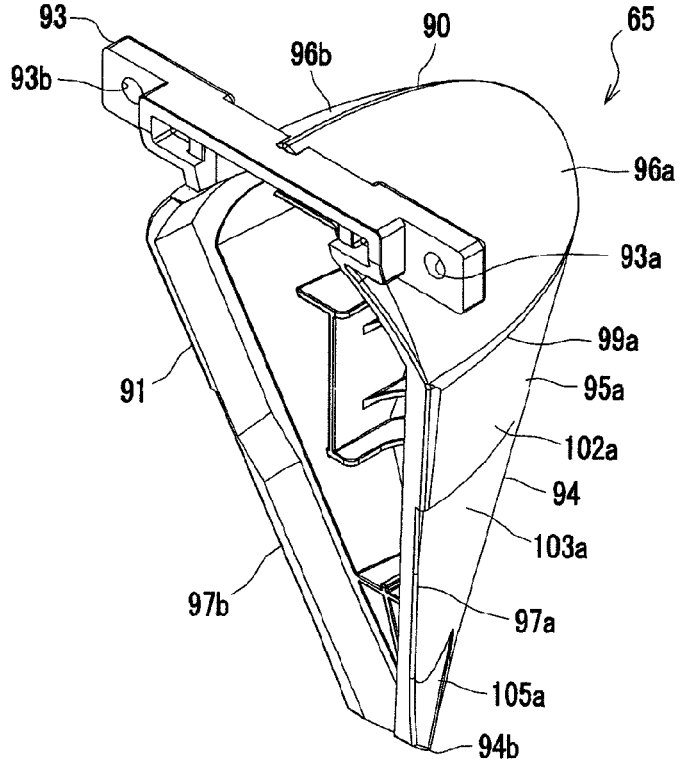
FIG. 14 is a perspective view for showing the unfolding guide of the first embodiment from the rear upper side.
Figure 15:
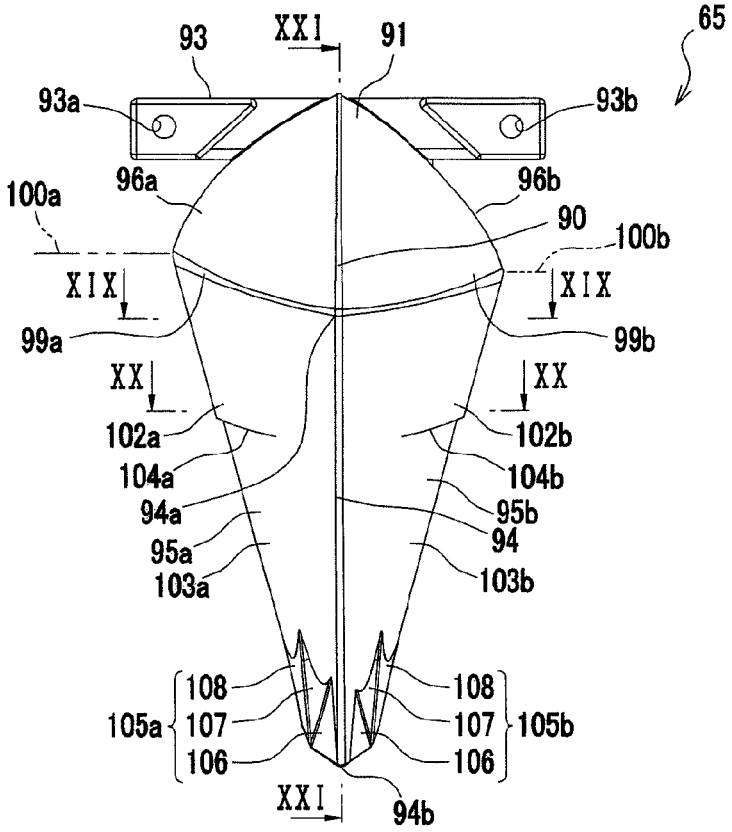
FIG. 15 is a front view of the unfolding guide of the first embodiment.
Figure 16:
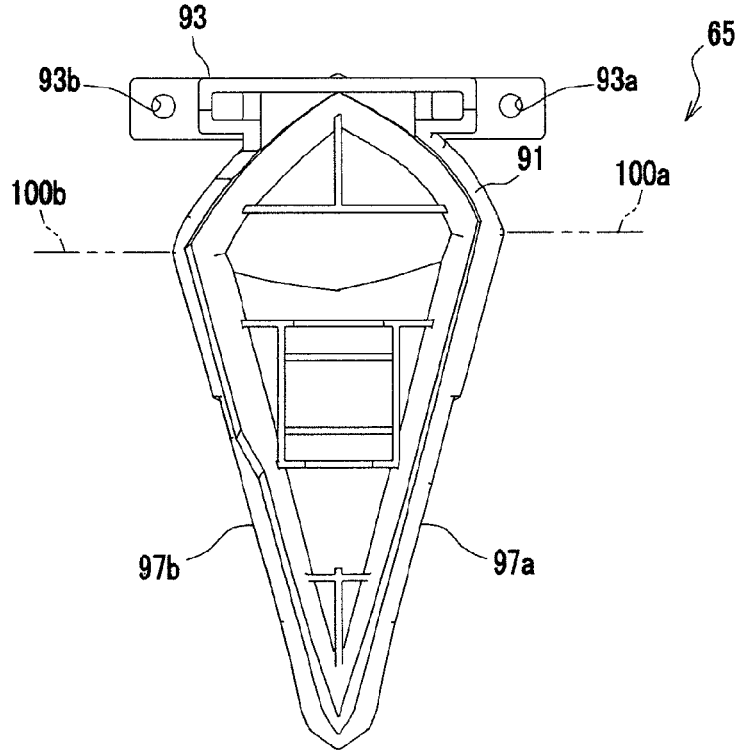
FIG. 16 is a back view of the unfolding guide of the first embodiment.
Figure 17:
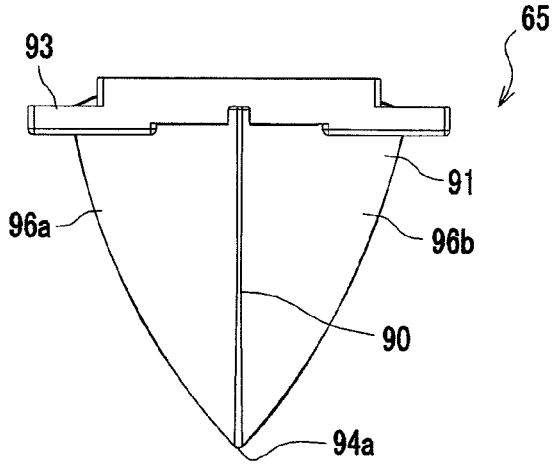
FIG. 17 is a plan view of the unfolding guide of the first embodiment.
Figure 18:
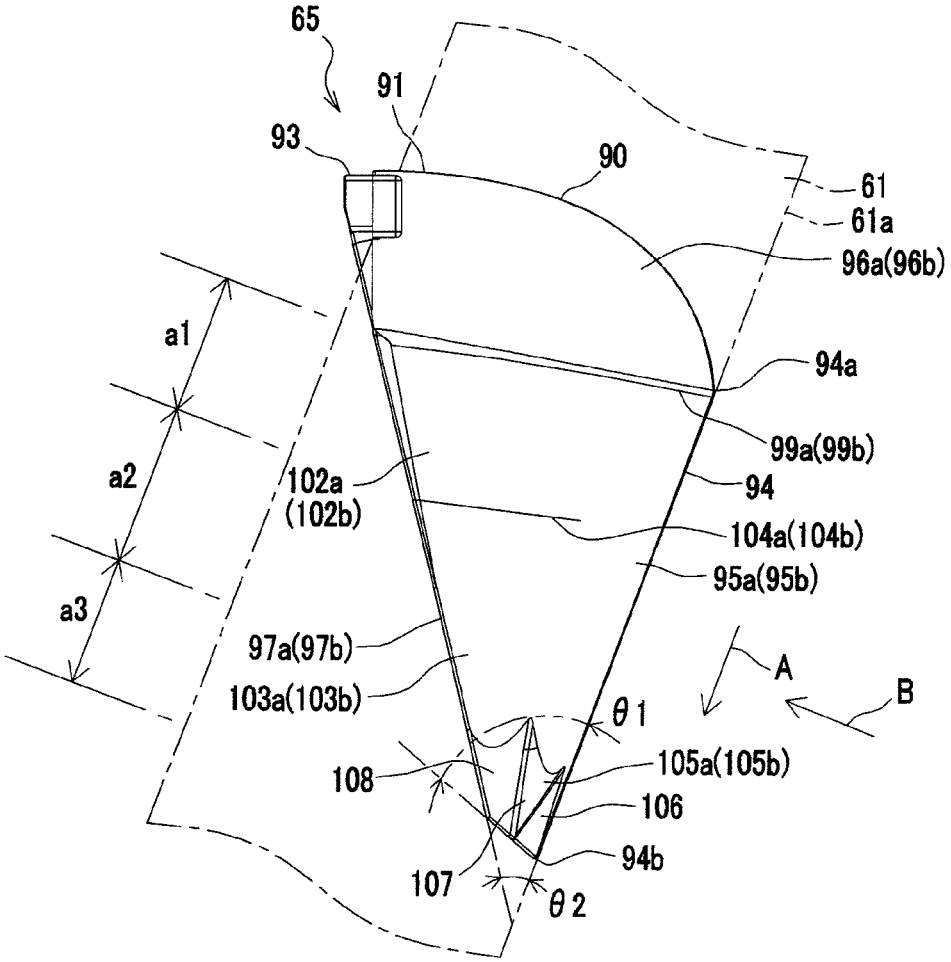
FIG. 18 is a left side view of the unfolding guide of the first embodiment.
Figure 19:
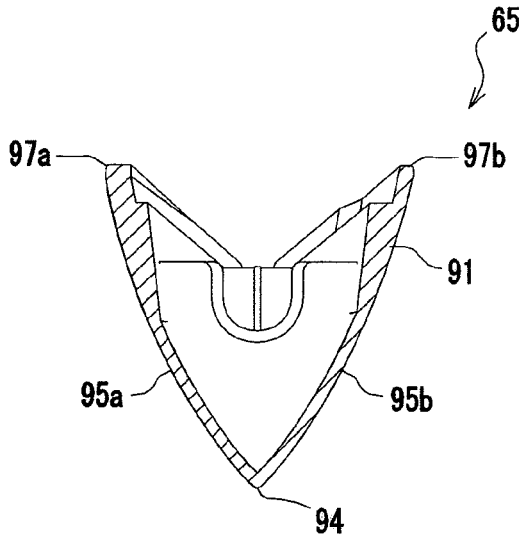
FIG. 19 is a cross sectional view taken along XIX-XIX line of FIG. 15.
Figure 20:
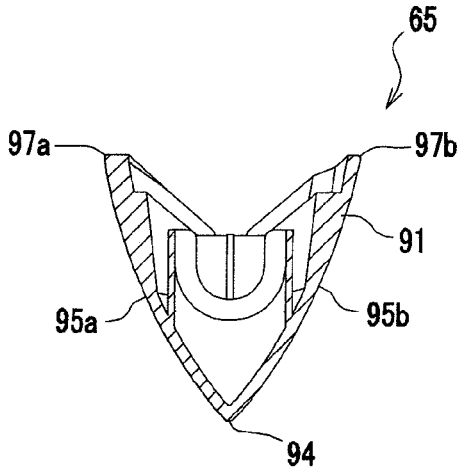
FIG. 20 is a cross sectional view taken along XX-XX line of FIG. 15.
Figure 21:
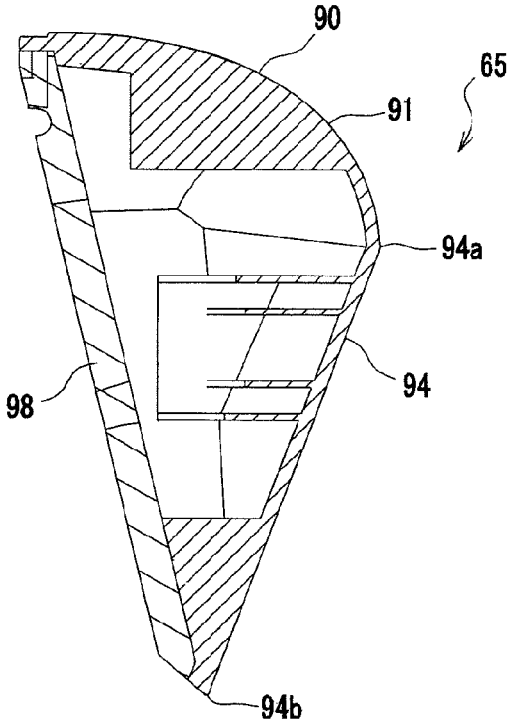
FIG. 21 is a cross sectional view taken along XXI-XXI line of FIG. 15.
Figure 22:
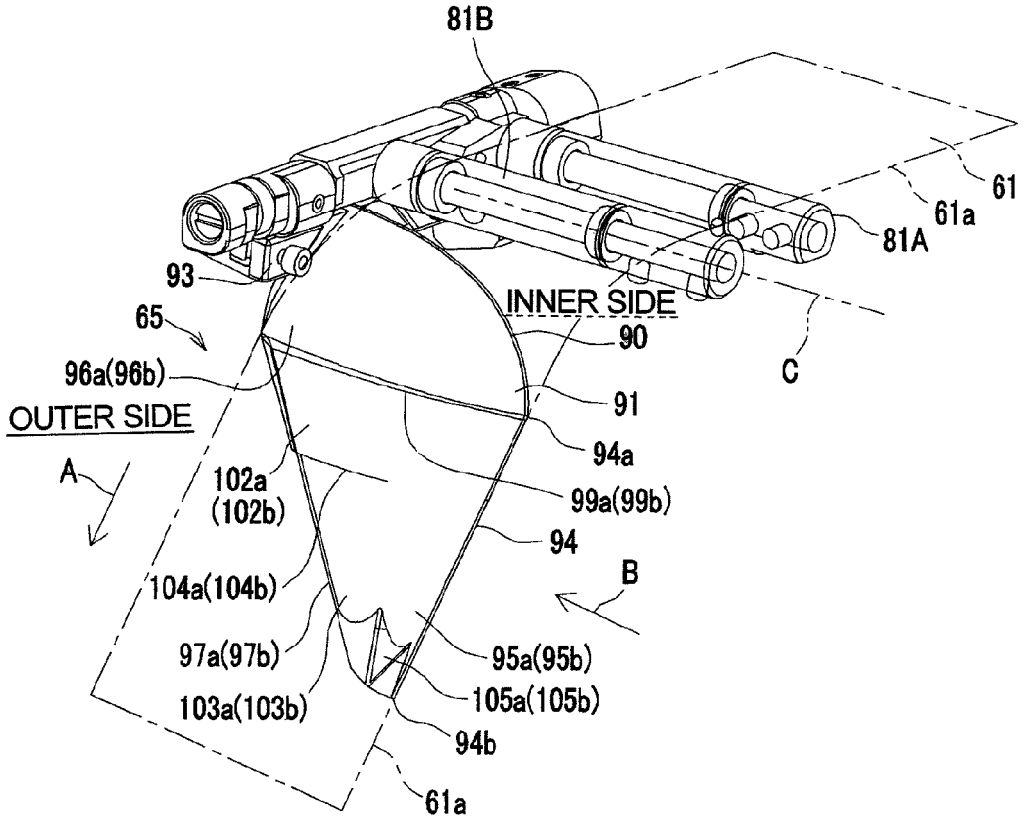
FIG. 22 is a perspective view showing the unfolding guide and curvature guide rollers of the first embodiment.
Figure 23:
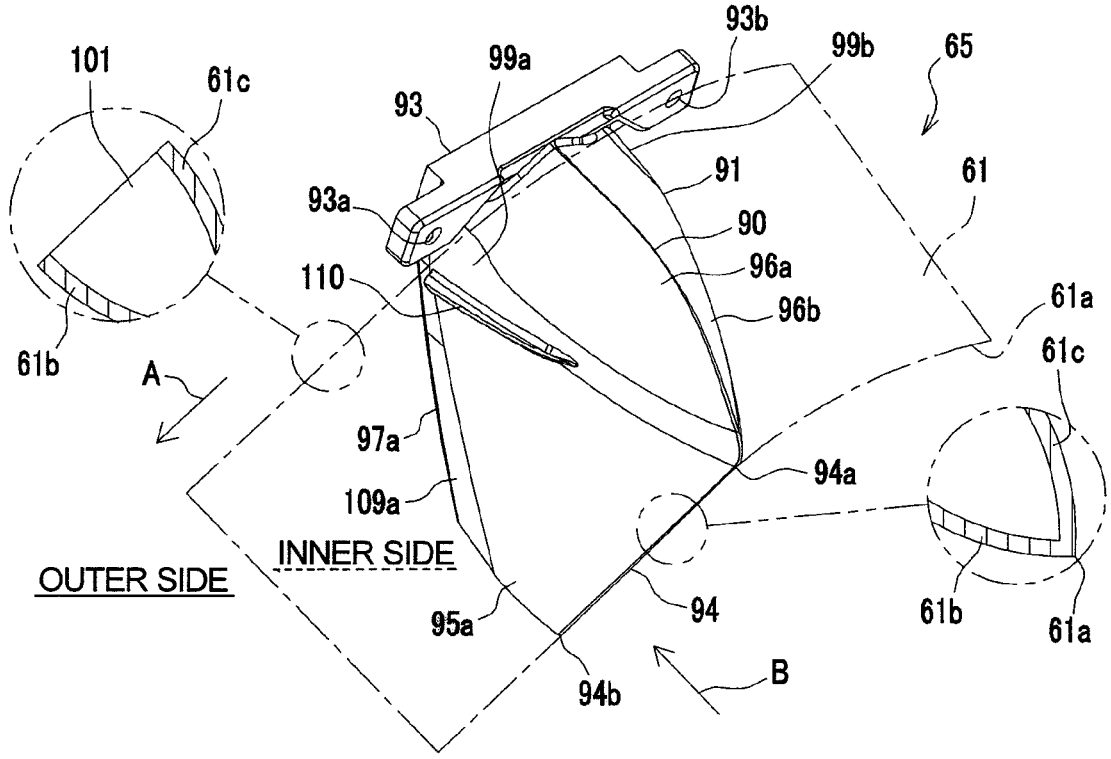
FIG. 23 is a perspective view for showing the unfolding guide of a second embodiment from the front upper side.
Figure 24:
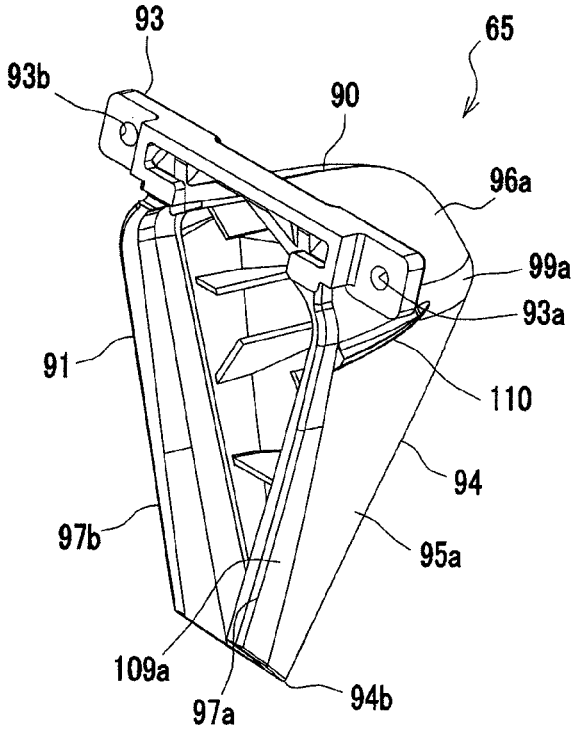
FIG. 24 is a perspective view for showing the unfolding guide of the second embodiment from the rear upper side.
Figure 25:
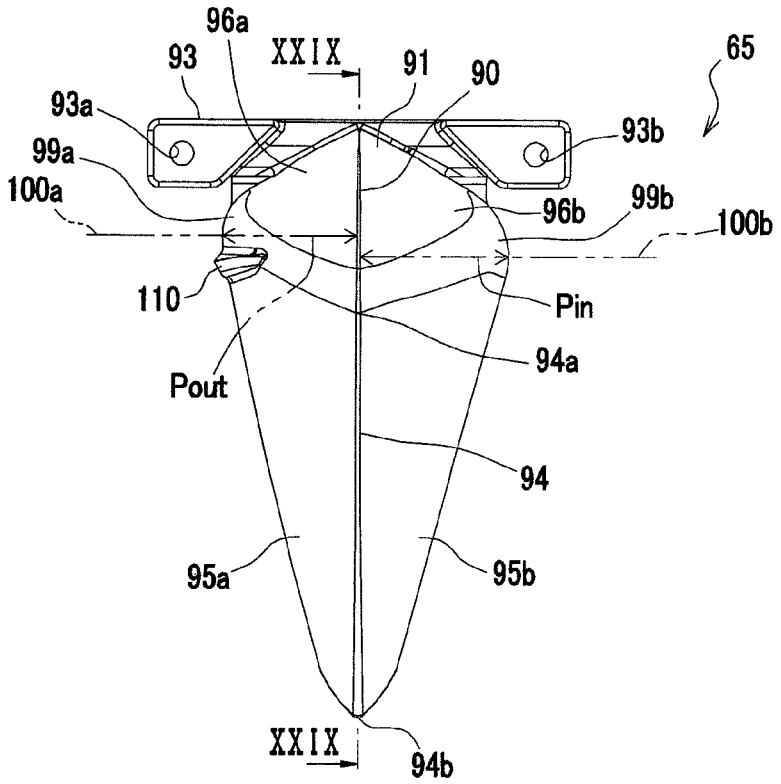
FIG. 25 is a front view of the unfolding guide of the second embodiment.
Figure 26:
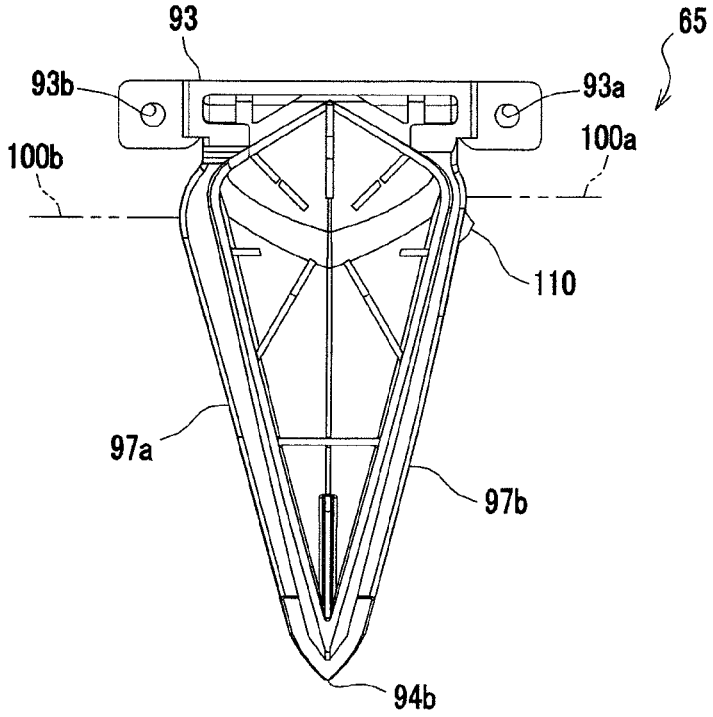
FIG. 26 is a back view of the unfolding guide of the second embodiment.
Figure 27:
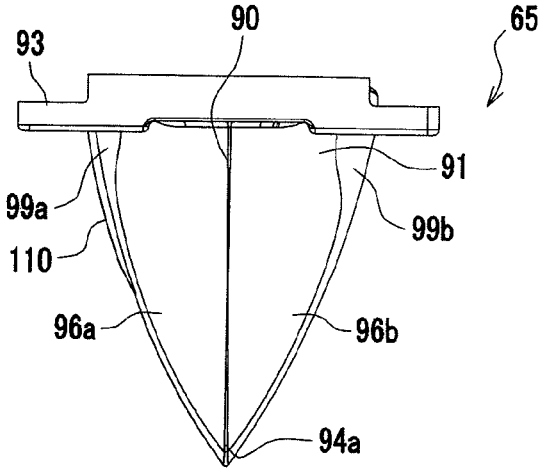
FIG. 27 is a plan view of the unfolding guide of the second embodiment.
Figure 28:
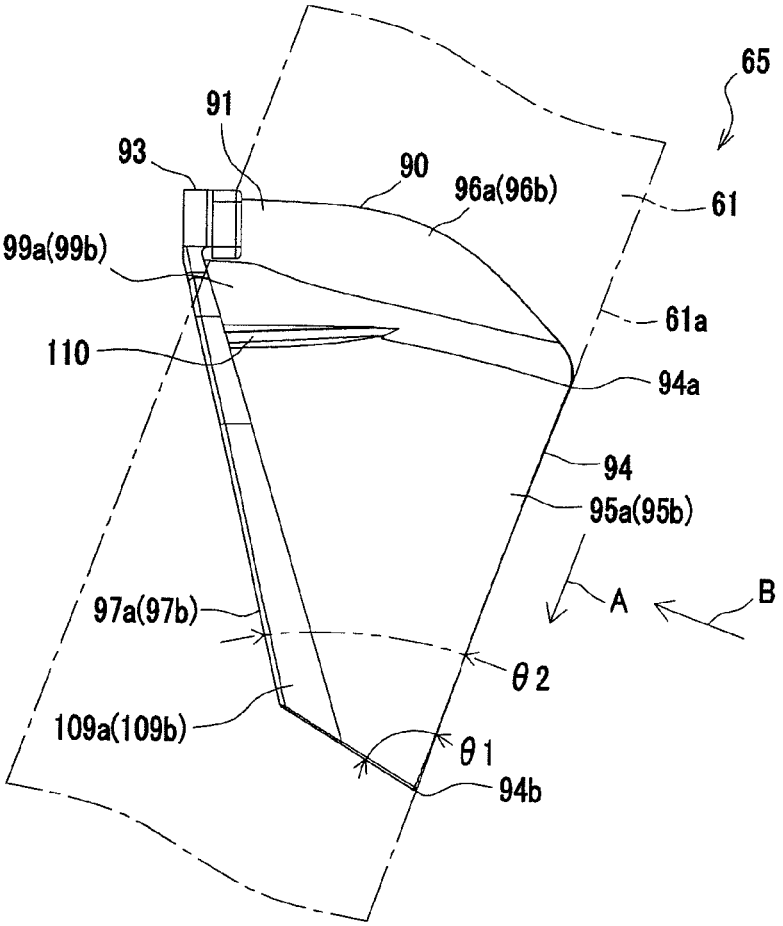
FIG. 28 is a left side view of the unfolding guide of the second embodiment.
Figure 29:
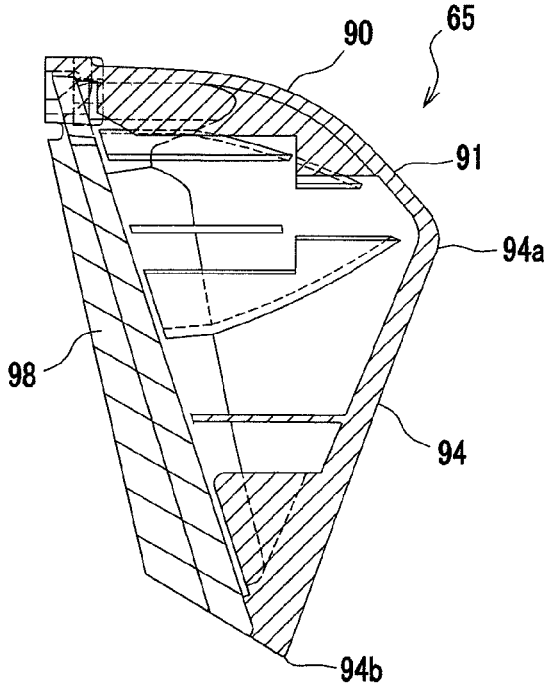
FIG. 29 is a cross sectional view taken along XXIX-XXIX line of FIG. 25.
Figure 30:
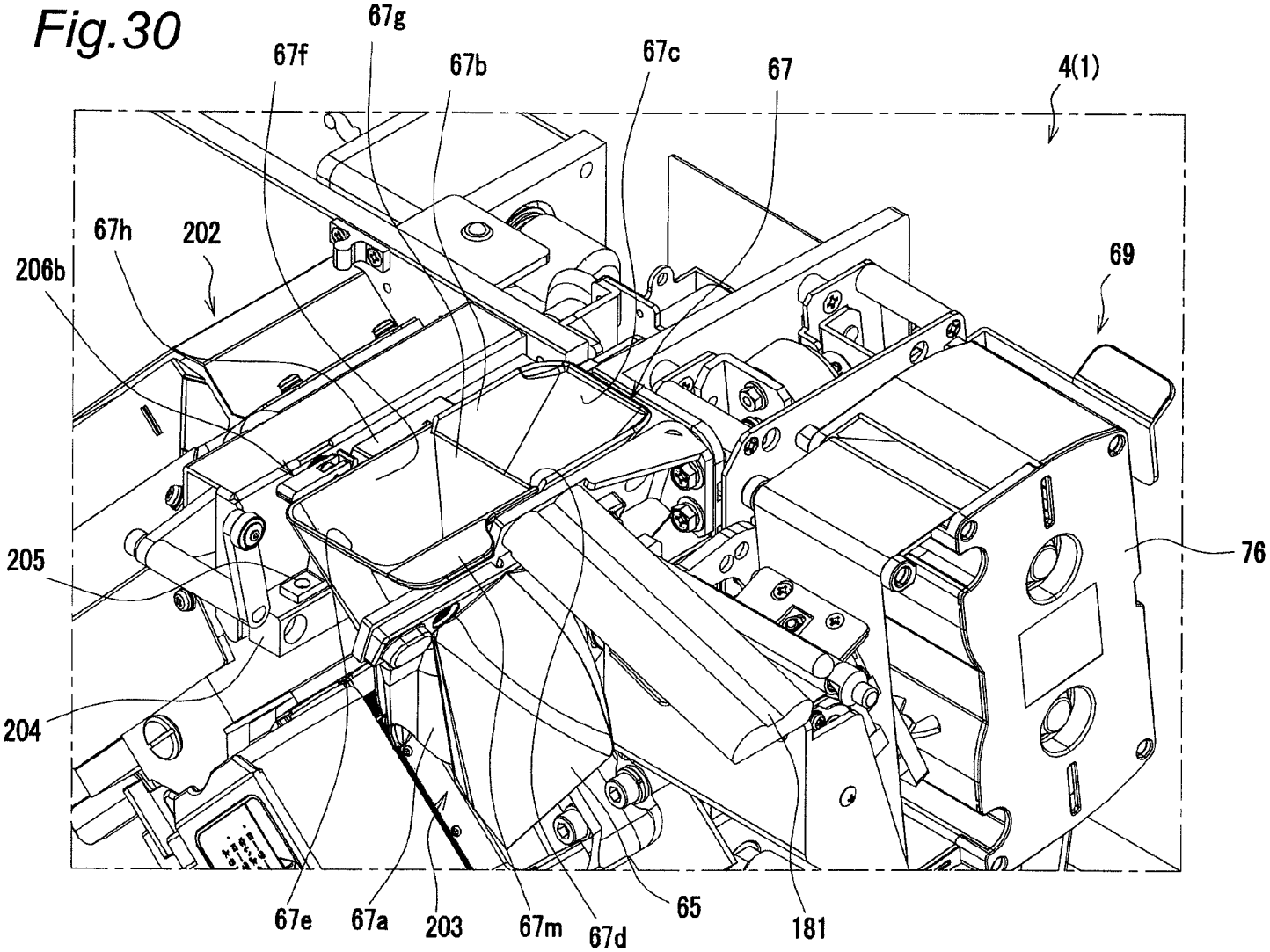
FIG. 30 is a partial perspective view showing the packaging unit of the medicine packaging apparatus according to a third embodiment of the present invention.
Figure 31:
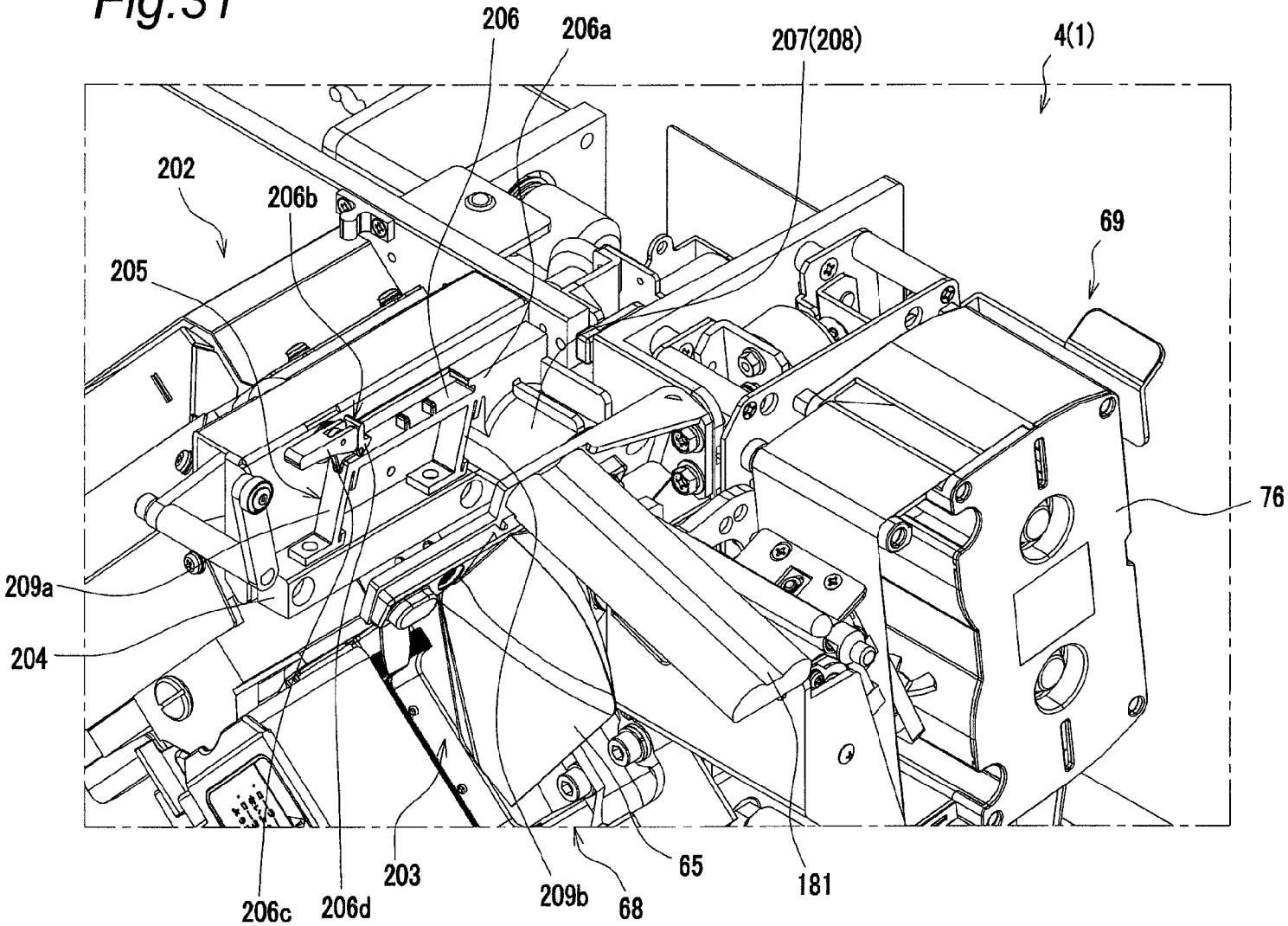
FIG. 31 is a partial perspective view showing the packaging unit of the third embodiment with a hopper removed.
Figure 32:
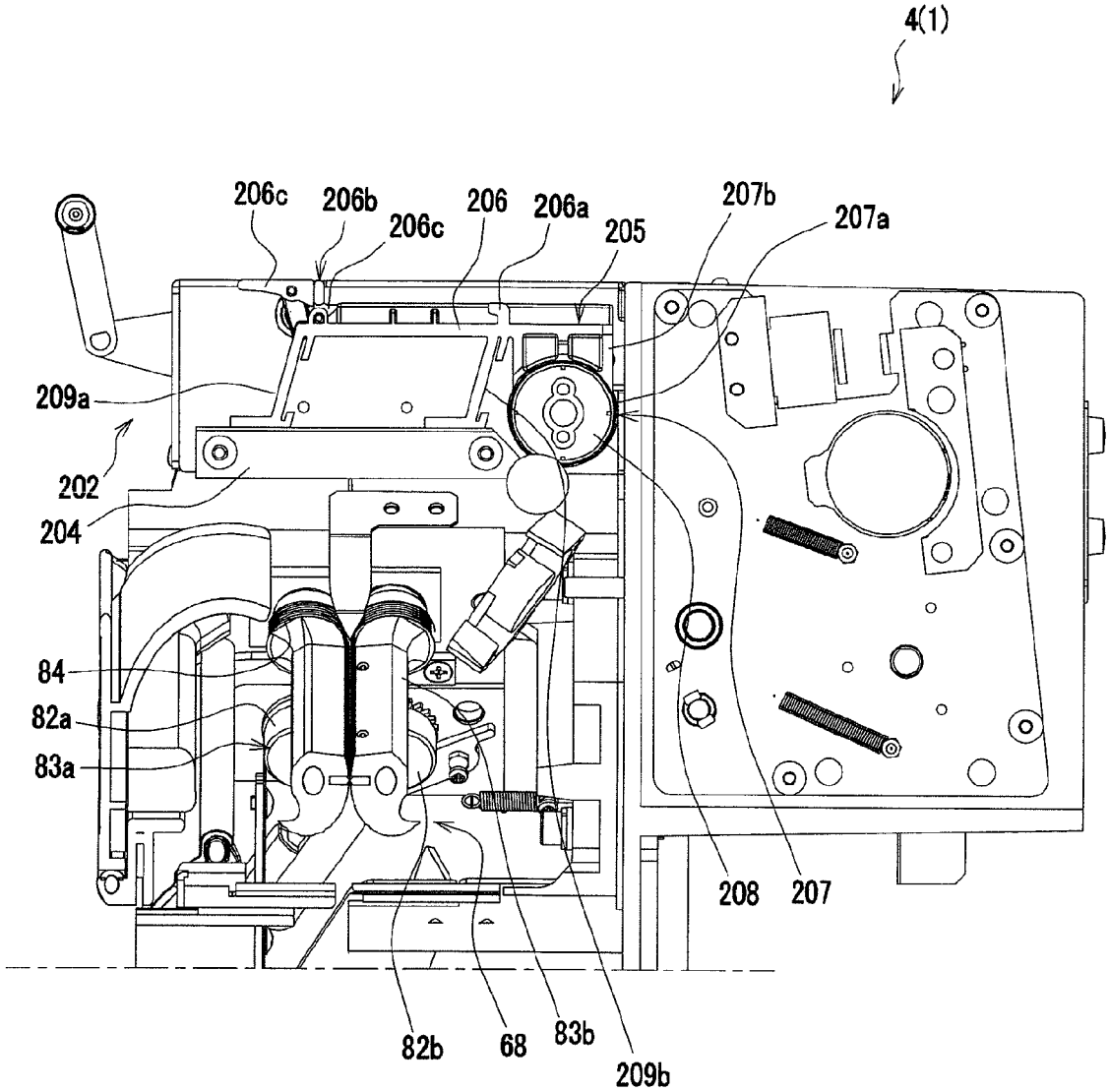
FIG. 32 is a partial front view showing the packaging unit of the third embodiment with the hopper removed.
Figure 33:
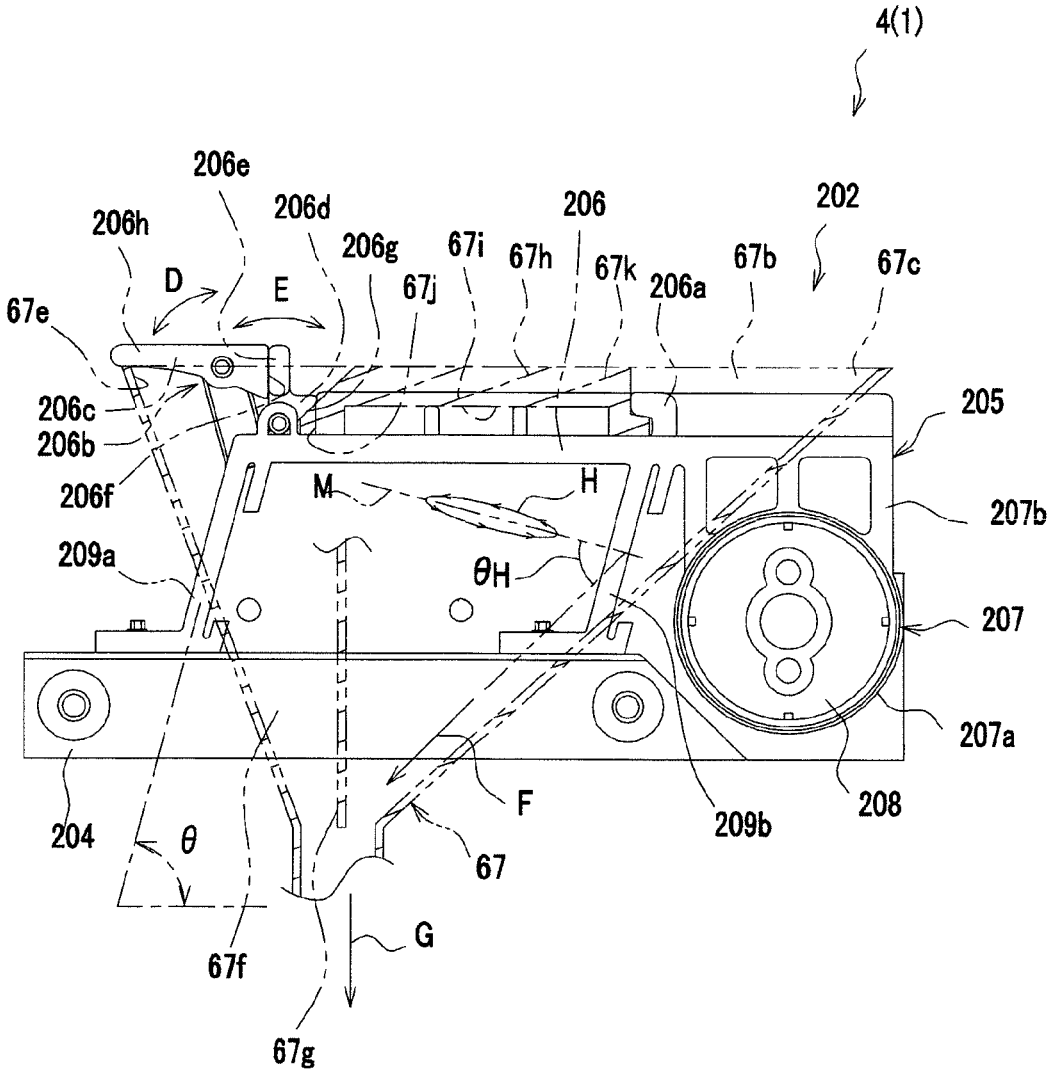
FIG. 33 is a schematic front view showing a hopper-side vibration applying mechanism.
Figure 34:
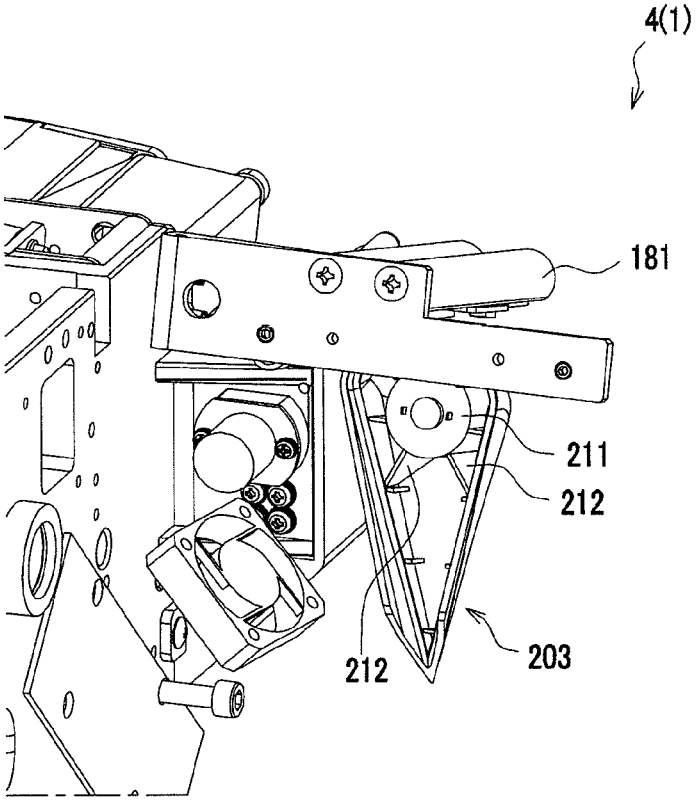
FIG. 34 is a partial perspective view showing an unfolding guide-side vibration applying mechanism.
Figure 35:
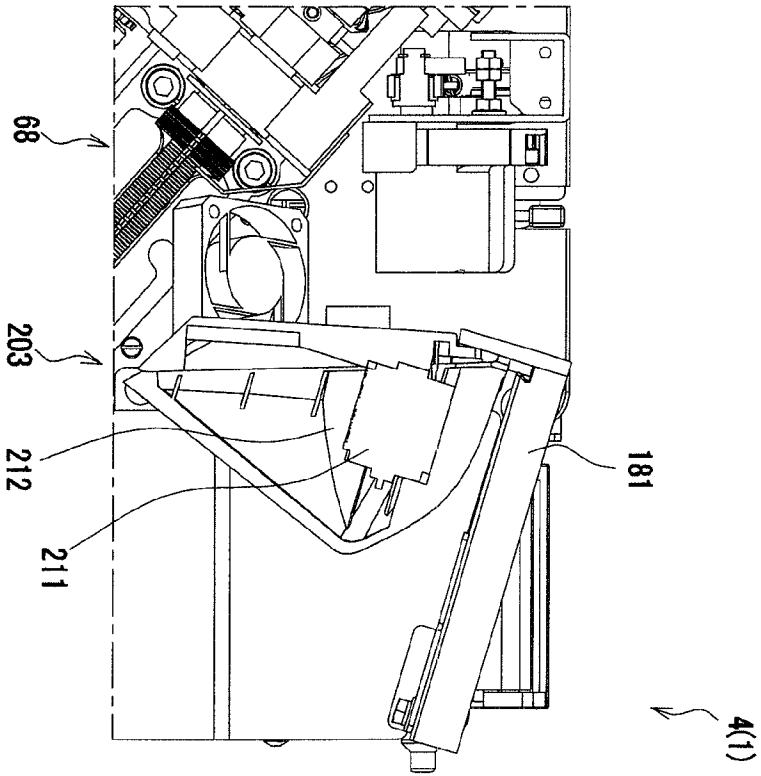
FIG. 35 is a partial sectional side view showing the unfolding guide-side vibration applying mechanism.
Figure 36:
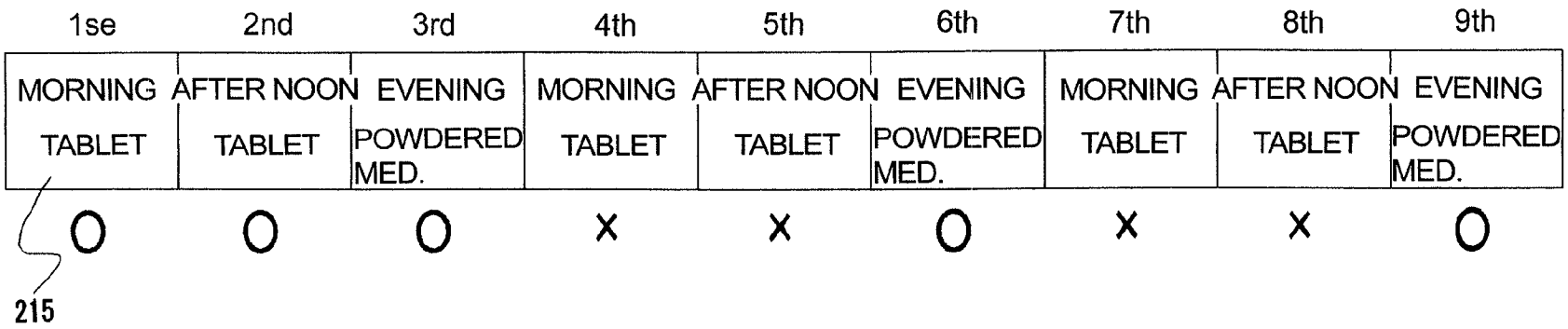
FIG. 36 is a schematic view showing an example of the presence/absence of operation of the vibration applying mechanism for every medicine bag.
Figure 37:
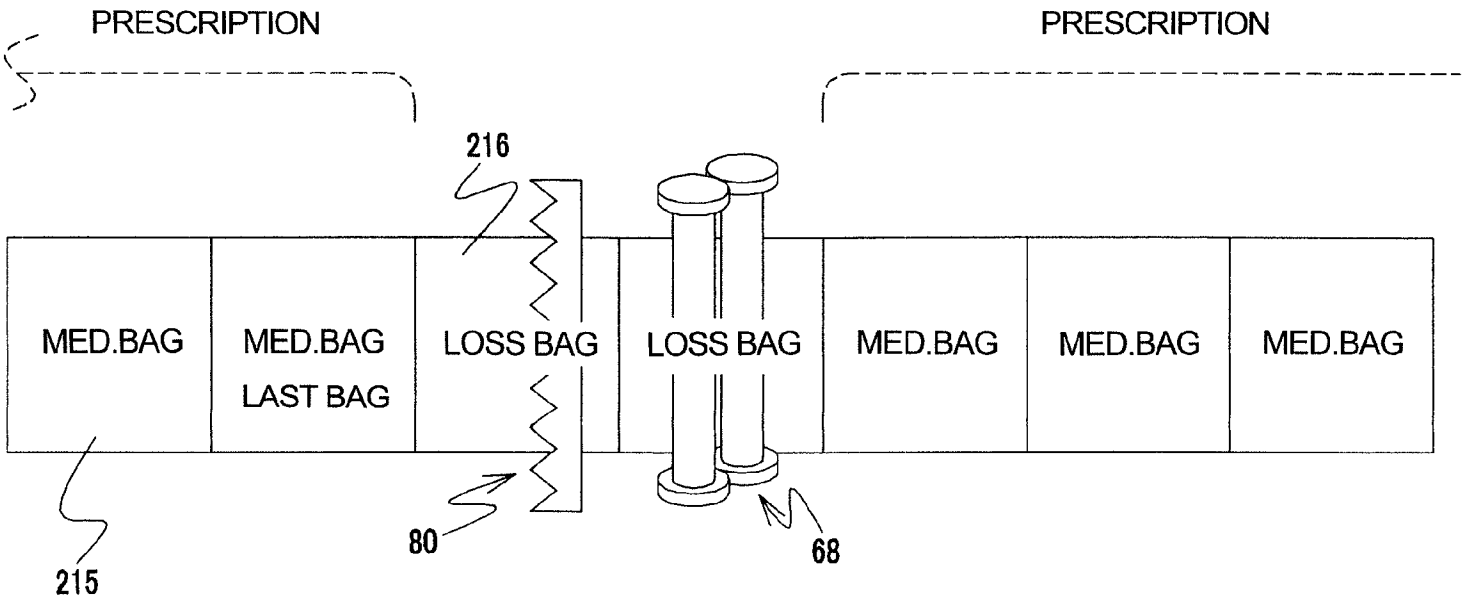
FIG. 37 is a schematic view for explaining the presence/absence of the operation of the vibration applying mechanism in the case where two loss bags are present.
Figure 38:
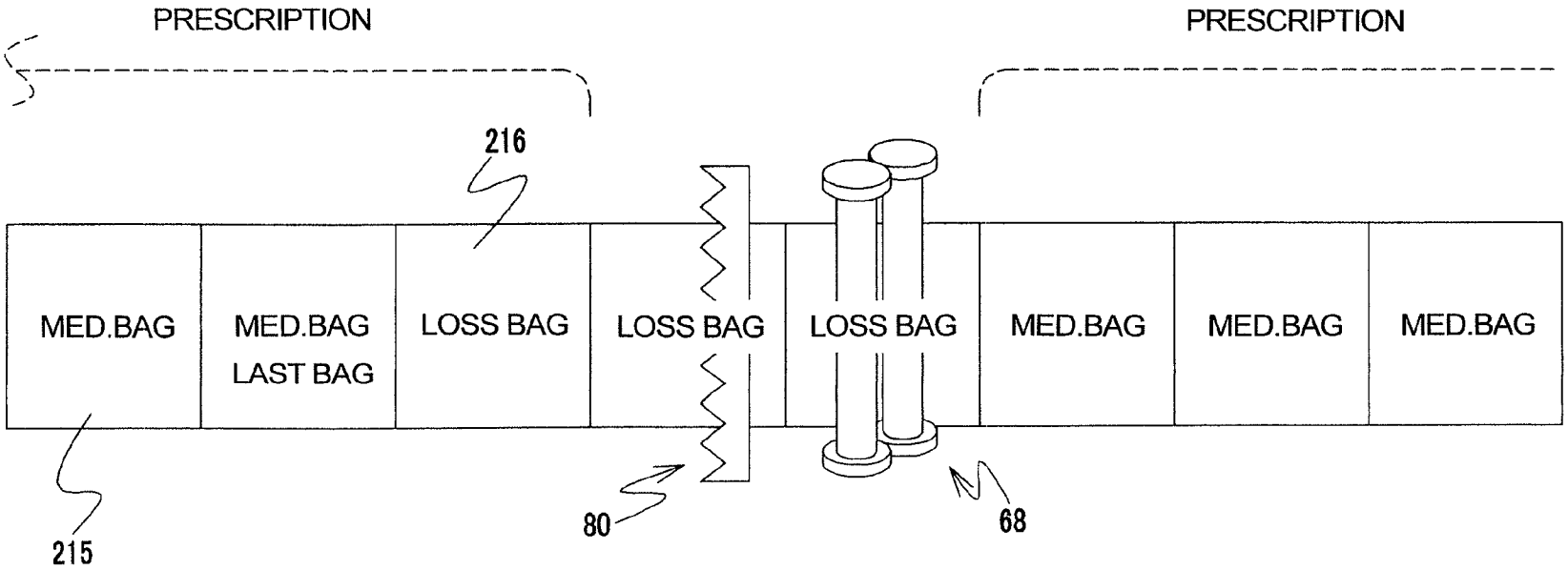
FIG. 38 is a schematic view for explaining the presence/absence of the operation of the vibration applying mechanism in the case where three loss bags are present.
Figure 39:
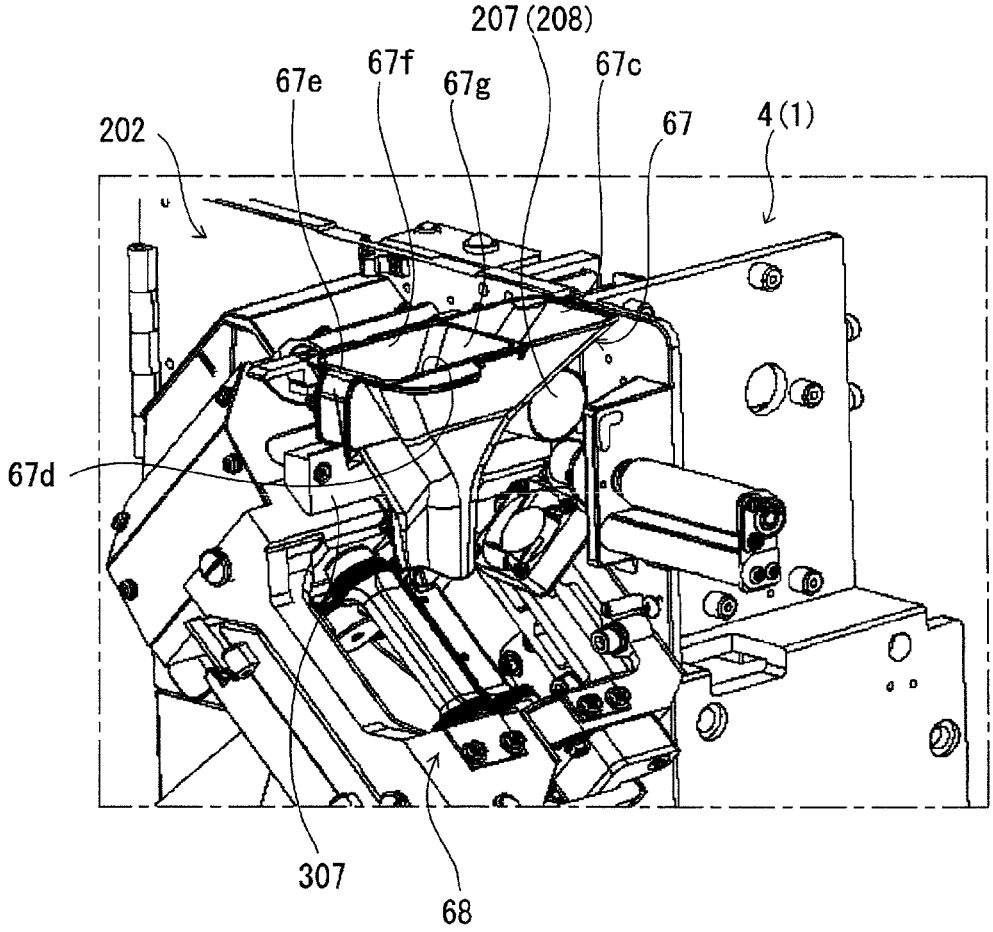
FIG. 39 is a partial perspective view showing the packaging unit of the medicine packaging apparatus according to a fourth embodiment of the present invention (with the hopper mounted)
Figure 40:
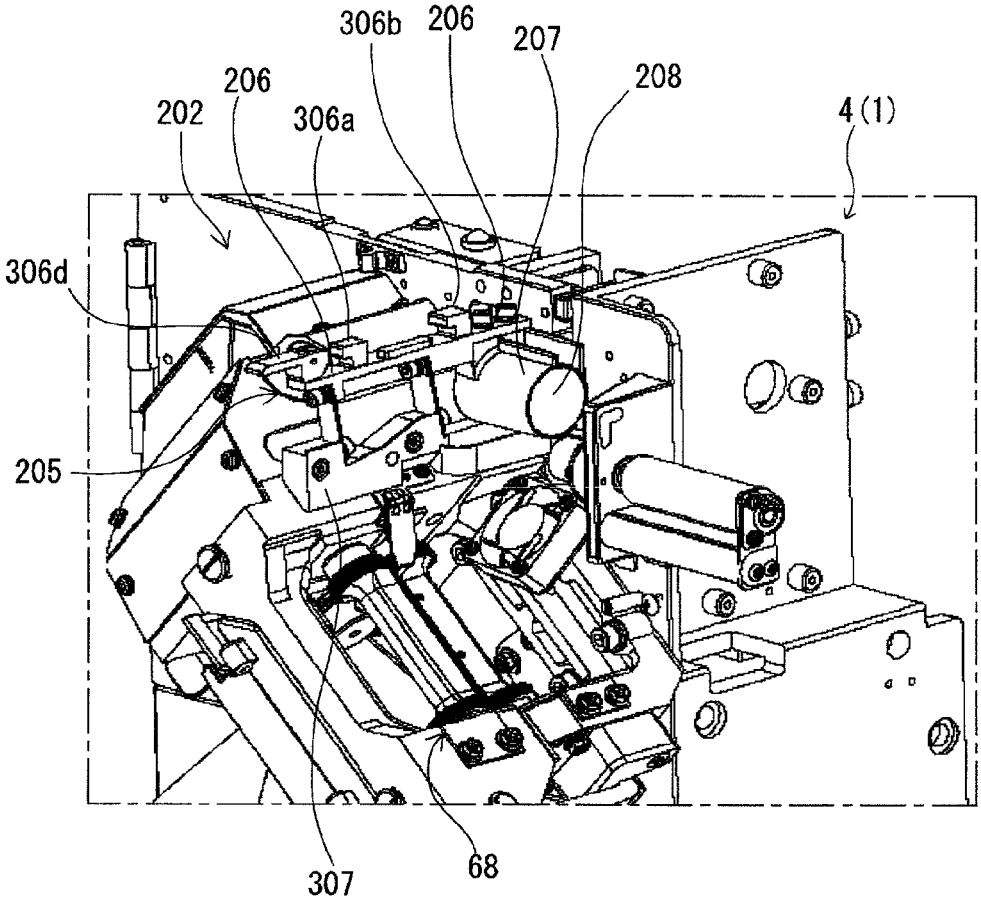
FIG. 40 is a partial perspective view showing the packaging unit of the medicine packaging apparatus according to the fourth embodiment of the present invention (with the hopper removed)
Figure 41:
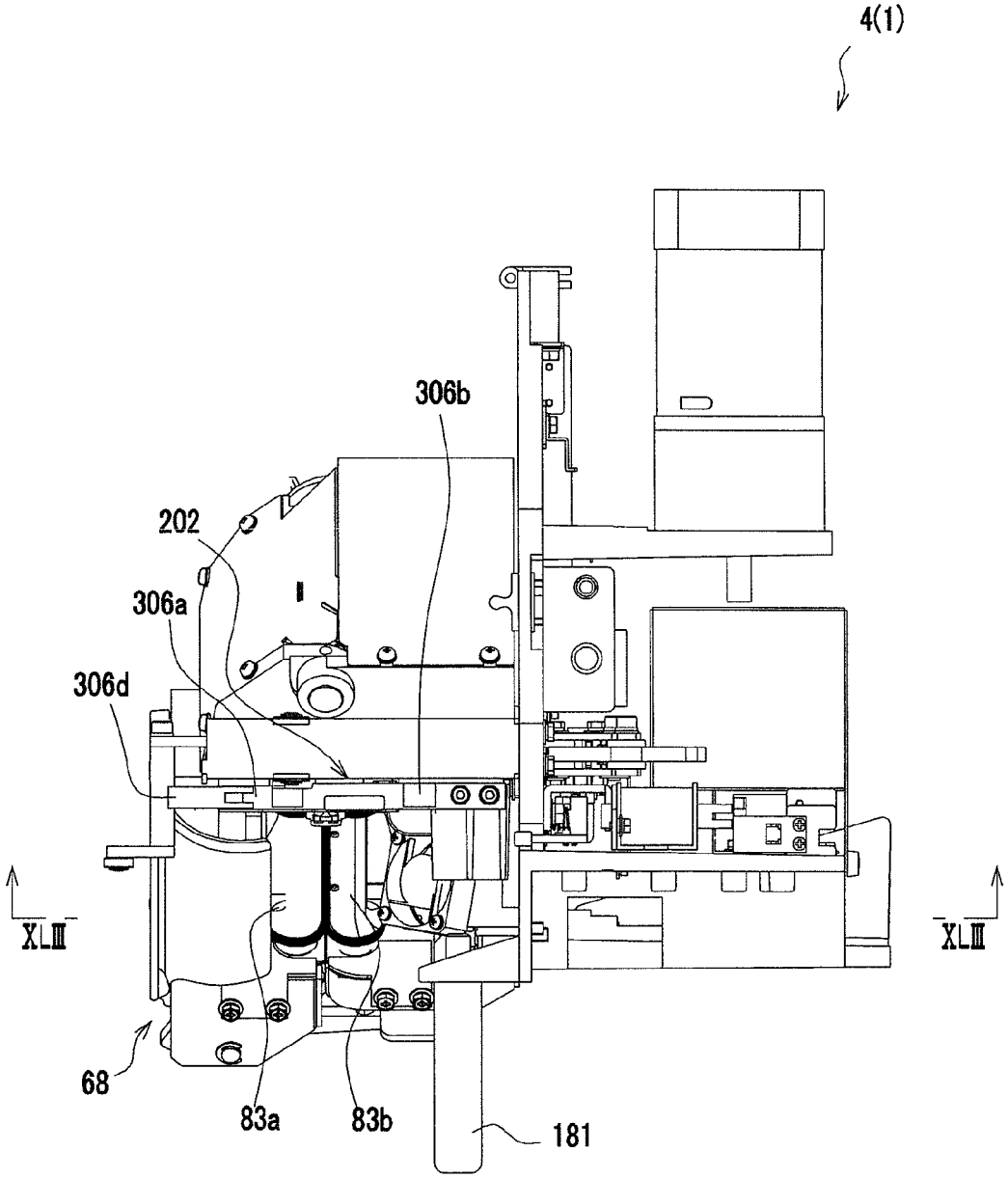
FIG. 41 is a plan view showing the packaging unit with the hopper removed.
Figure 42:
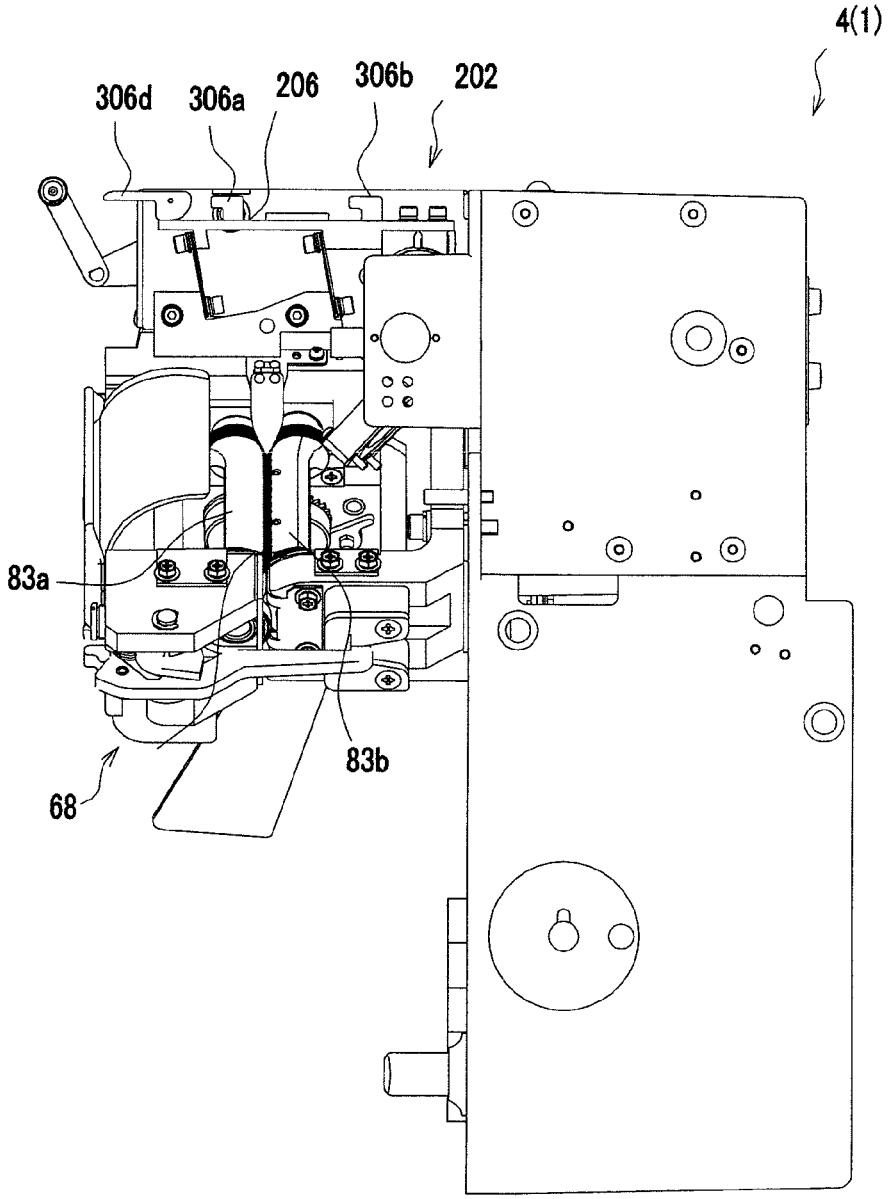
FIG. 42 is a right side view showing the packaging unit with the hopper removed.
Figure 43:
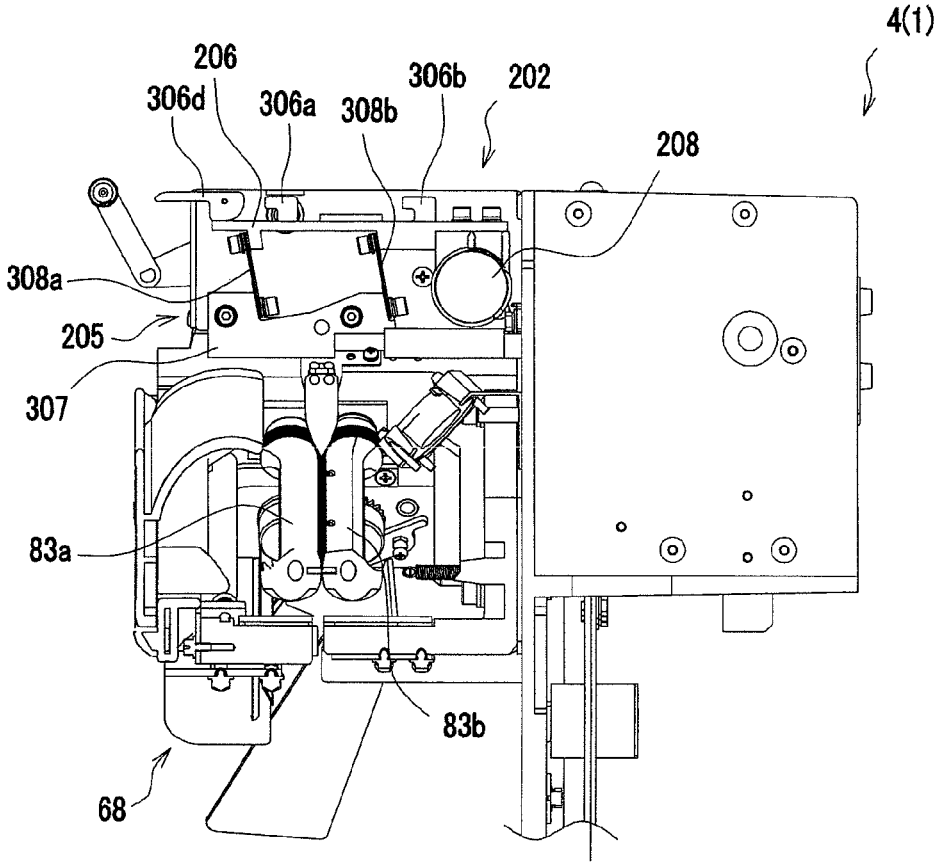
FIG. 43 is a cross sectional view taken along XLIII-XLIII line of FIG. 41.
Figure 44:
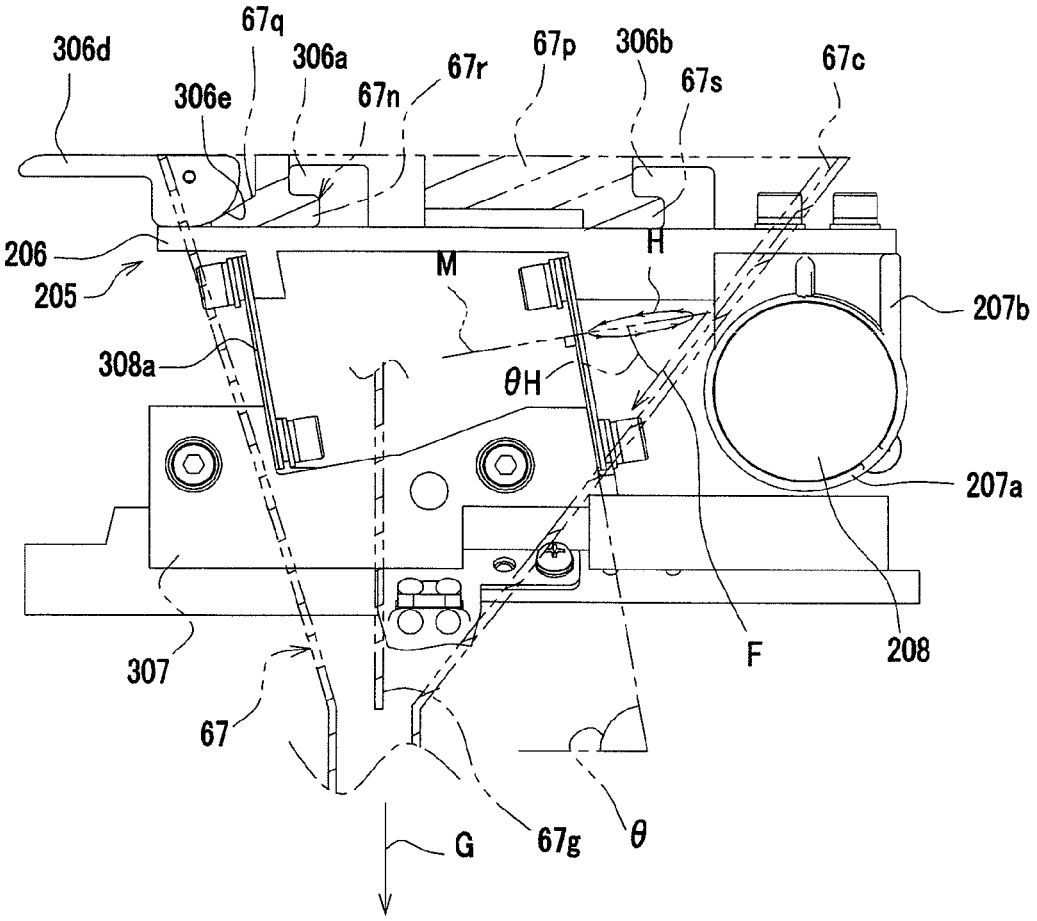
FIG. 44 is a partial perspective view showing the hopper-side vibration applying mechanism.
Figure 45:
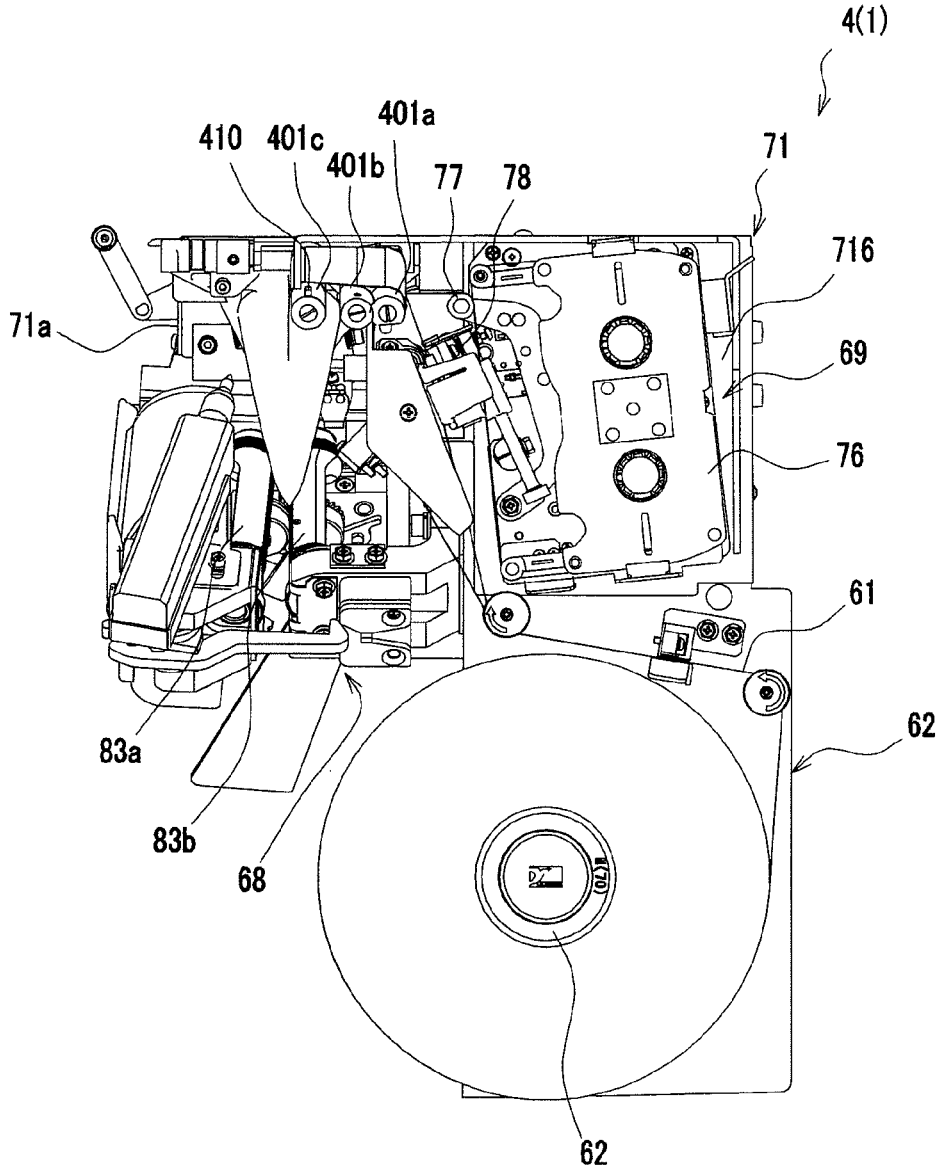
FIG. 45 is a right side view of the packaging unit included in the medicine packaging apparatus according to a modified example of the present invention.
Figure 46:
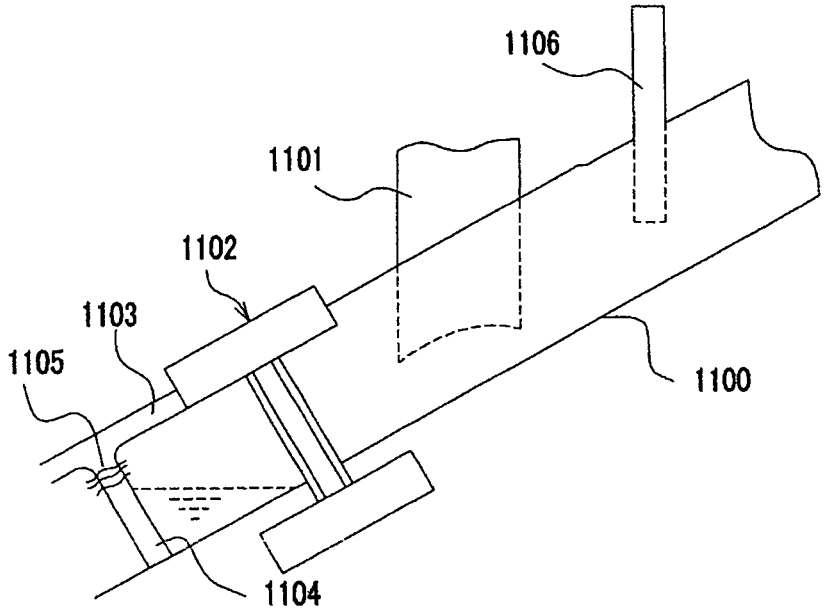
Fig.46 (PRIOR ART)
FIG. 46 is a schematic view showing the structure around an unfolding guide in a conventional medicine packaging apparatus.
Figure 47:
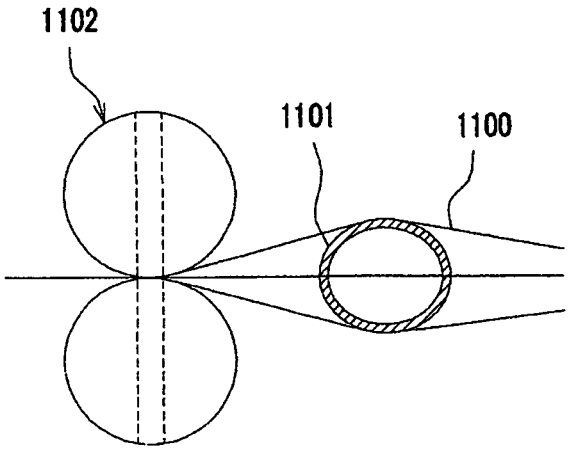
Fig.47 (PRIOR ART)
FIG. 47 is a schematic plan view showing the structure around a nozzle section of a hopper in the conventional medicine packaging apparatus.

The invention claimed is:

1. A medicine packaging apparatus, comprising:

a sheet supply section for unrolling and feeding an elongated package sheet from a roll on which the package sheet is wound, the package sheet previously being folded along its longitudinal direction into two portions;

a printing section for making a print on the package sheet fed from the sheet supply section;

a curvature guide for curving a conveying direction of the package sheet having passed the printing section;

an unfolding guide arranged on a downstream side of the curvature guide in the conveying direction of the package sheet, the unfolding guide unfolding and opening the two-folded package sheet;

a medicine introducing section arranged on the downstream side of the unfolding guide in the conveying direction of the package sheet, the medicine introducing section introducing a medicine into an opening of the package sheet; and a heat sealing section arranged on the downstream side of the medicine introducing section in the conveying direction of the package sheet, the heat sealing section sealing the package sheet so as to enclose the introduced medicine, wherein the unfolding guide comprises:

a main ridge extending along with a crease of the package sheet; and a pair of unfolding guide surfaces which are convex curved surfaces extending from the main ridge and which respectively come into contact with the two portions of the folded package sheet, and wherein the unfolding guide surfaces have different outer peripheral shapes so that, as seen from a direction facing the main ridge, a contact start position of one of the unfolding guide surfaces, disposed on an outer side of a curve of the conveying direction by the curvature guide relative to the main ridge, is located on an upstream side in the conveying direction of the package sheet with respect to a contact start position of the other of the unfolding guide surfaces disposed on an inner side of the curve of the conveying direction by the curvature guide relative to the main ridge.

2. The medicine packaging apparatus according to claim 1, wherein, seen from the conveying direction of the package sheet, a distance between the pair of unfolding guide surfaces increases as the unfolding guide surfaces are farther away from the main ridge, and wherein, seen from the direction facing the main ridge, the distance between the unfolding guide surfaces becomes narrower from the upstream side to the downstream side in the conveying direction.

3. The medicine packaging apparatus according to claim 1, wherein each of the unfolding guide surfaces includes:

a rear end edge gradually coming close to the main ridge from the upstream side to the downstream side in the conveying direction of the package sheet, the rear end edge being jointed to an end section of the main ridge on the downstream side in the conveying direction of the package sheet; and a first concave section formed in a portion ranging from a position spaced from the main ridge to the rear end edge in a region between a position spaced from the contact start positions on the downstream side in the conveying direction of the package sheet and the end section on the downstream side.

4. The medicine packaging apparatus according to claim 3, wherein each of the unfolding guide surfaces includes a second concave section formed on the downstream side of the first concave section in the conveying direction of the package sheet in a region including the end section of the main ridge on the downstream side.

5. The medicine packaging apparatus according to claim 4, wherein an area of the second concave section of the unfolding guide surface located on the outer side of the curve in the conveying direction made by the curvature guide relative to the main ridge is larger than an area of the second concave section of the unfolding guide surface located on the inner side of the curve in the conveying direction made by the curvature guide relative to the main ridge.

6. The medicine packaging apparatus according to claim 1, wherein a linear projection extending in the direction crossing the main ridge is provided at a position adjacent to the contact start position of the unfolding guide surface located on the outer side of the curve in the conveying direction by the curvature guide relative to the main ridge.

7. The medicine packaging apparatus according to claim 6, wherein a bulge amount of the unfolding guide surface located on the inner side of the curve in the conveying direction by the curvature guide relative to the main ridge is larger than a bulge amount at the contact start position of the unfolding guide surface located on the outer side of the curve in the conveying direction by the curvature guide relative to the main ridge.

8. The medicine packaging apparatus according to claim 1, wherein the unfolding guide further comprises:

a sub ridge extending from an end section of the main ridge on the upstream side in the conveying direction of the package sheet to the upstream side in the conveying direction of the package sheet; and a pair of top surfaces which are convex curved surfaces stretching from the sub ridge and which are joined to the unfolding guide surfaces.

9. The medicine packaging apparatus according to claim 1, wherein the heat sealing section is provided with a pair of rotatable heater rollers.

10. The medicine packaging apparatus according to claim 1, further comprising:

a first vibration applying mechanism for applying vibration to the unfolding guide.

11. The medicine packaging apparatus according to claim 10, wherein the first vibration applying mechanism comprises a vibration source fixed within the unfolding guide.

12. The medicine packaging apparatus according to claim 10, wherein the medicine introducing section is provided with a hopper having on the upper side an inlet opening into which the medicine is fed and having on a lower side a nozzle section inserted into the opening of the two-folded package sheet for introducing the medicine into the package sheet, and wherein the medicine packaging apparatus further comprises a second vibration applying mechanism for applying vibration to the hopper.

13. The medicine packaging apparatus according to claim 12, wherein the second vibration applying mechanism is provided with a second vibration source and a holding structure for holding the second vibration source and the hopper.

14. The medicine packaging apparatus according to claim 1, wherein, due to the different shapes of the pair of unfolding guide surfaces, the unfolding guide surfaces are asymmetric relative to the main ridge.

* * * * *